US010035345B2

(12) United States Patent
Hattori et al.

(10) Patent No.: US 10,035,345 B2
(45) Date of Patent: Jul. 31, 2018

(54) INKJET RECORDING APPARATUS AND CONTROL METHOD THEREFOR

(71) Applicant: FUJIFILM Corporation, Tokyo (JP)

(72) Inventors: Kazumasa Hattori, Kanagawa (JP); Yuichi Ozaki, Kanagawa (JP); Tsutomu Kusakari, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/460,211

(22) Filed: Mar. 15, 2017

(65) Prior Publication Data

US 2017/0266964 A1 Sep. 21, 2017

(30) Foreign Application Priority Data

Mar. 17, 2016 (JP) ..... 2016-054290

(51) Int. Cl.
*B41J 2/165* (2006.01)
*B41J 2/045* (2006.01)

(52) U.S. Cl.
CPC ..... *B41J 2/04586* (2013.01); *B41J 2/165* (2013.01); *B41J 2/16508* (2013.01); *B41J 2002/16573* (2013.01)

(58) Field of Classification Search
None
See application file for complete search history.

(56) References Cited

U.S. PATENT DOCUMENTS 8,926,038 B2 1/2015 Tamaki
2010/0079515 A1* 4/2010 Kuwahara ..... B41J 2/16585 347/7

OTHER PUBLICATIONS

IP.com search.*

* cited by examiner

*Primary Examiner* — Lisa M Solomon
(74) *Attorney, Agent, or Firm* — JCIPRNET

(57) ABSTRACT

A control method for an inkjet recording apparatus includes: a head housing step of housing in a head housing part an inkjet head having a nozzle surface on which nozzles configured to eject an ink are formed; a humidity acquiring step of acquiring a relative humidity of the nozzle surface of the inkjet head housed in the head housing part; and a temperature and humidity regulating step of performing at least one of a humidification process and a dehumidification process according to the relative humidity of the nozzle surface acquired in by the humidity acquiring step to set the relative humidity of the nozzle surface to 37% RH or more and 65% RH or less.

11 Claims, 18 Drawing Sheets

INKJET RECORDING APPARATUS AND CONTROL METHOD THEREFOR

CROSS-REFERENCE TO RELATED APPLICATIONS

The present application claims priority under 35 U.S.C. § 119 to Japanese Patent Application No. 2016-054290, filed on Mar. 17, 2016. The above application is hereby expressly incorporated by reference, in its entirety, into the present application.

BACKGROUND OF THE INVENTION

Field of the Invention

The presently disclosed subject matter relates to an inkjet recording apparatus and a control method therefor, particularly to an inkjet recording apparatus provided with a wetting device for wetting a portion around a nozzle of an inkjet head, and a control method therefor.

Description of the Related Art

There is disclosed in Japanese Patent Application Laid-Open No. 2012-158018 a liquid ejection apparatus in which an ejection space facing a plurality of ejection openings of an liquid ejection head is brought into a sealed state by means of a cap so as to be humidified (in paragraphs [0054] and [0058] in Japanese Patent Application Laid-Open No. 2012-158018). In Japanese Patent Application Laid-Open No. 2012-158018, a humidity in the ejection space is controlled to be a predetermined humidity by a temperature of humid air, a supply amount of the humid air per unit time, or the like. There is described in the above document that this predetermined humidity is a humidity when a viscosity of ink in the head is within a proper range in terms of an image quality, and only a lower limit value of the humidity, that is, a humidity corresponding to an upper limit value of the viscosity may be defined.

There is disclosed in Japanese Patent Application Laid-Open No. 2003-145783 an ink jet unit in which evaporation of a solvent in ink can be reduced or prevented by bringing a solvent vapor concentration in a space outside of a nozzle close to a solvent vapor concentration inside the nozzle in the vicinity of a meniscus surface or by providing an environment having at least a relative humidity equal to or more than 60% RH (in a paragraph [0014] in Japanese Patent Application Laid-Open No. 2003-145783). There is described in Japanese Patent Application Laid-Open No. 2003-145783 that if a superabsorbent polymer in a form of sheet having a thickness of 0.1 mm made of a hydrolytic fibrous superabsorbent polymer of acrylic fibers (Lanseal (registered trademark) from Japan Exlan Co., LTD.) is used for a holder of an inkjet head, the relative humidity of the space in the vicinity of the nozzle can be set to 65% RH to 76% RH in a winter environment and 76% RH to 85% RH in a summer environment due to an action of moisture transpiration from this superabsorbent polymer (in paragraphs [0024] and [0025] in Japanese Patent Application Laid-Open No. 2003-145783).

SUMMARY OF THE INVENTION

An inkjet print apparatus of related art has a problem that the ink remaining on the nozzle surface of the inkjet head may be dried to increase the ink viscosity so that this remaining ink with the increased viscosity inhibits ink ejection. In order to prevent such a deterioration of the ink ejection caused by the remaining ink, it has been proposed that the inkjet head is housed in a cap to wet the nozzle surface of the inkjet head when the inkjet head is not driven.

However, the inventors of the presently disclosed subject matter have found that if the humidity of the nozzle surface of the inkjet head is increased, dew condensation occurs on the nozzle surface and water droplets generated by the dew condensation cause an adverse effect on the ink ejection.

Japanese Patent Application Laid-Open No. 2012-158018 discloses that the humidity in the ejection space is kept to be a humidity when the ink viscosity is within the proper range, but does not disclose prevention of the dew condensation on the nozzle surface of the inkjet head.

Japanese Patent Application Laid-Open No. 2003-145783 discloses setting the relative humidity to 60% RH or more, which is capable of decreasing or preventing the evaporation of the solvent in the ink, but does not disclose that the relative humidity is adjusted to prevent the dew condensation on the nozzle surface of the inkjet head.

Note that Japanese Patent Application Laid-Open No. 2003-145783 discloses results of experiments about the relative humidity in a space in the vicinity of a nozzle when a holder made of a certain superabsorbent polymer is used, but the experimental results in Japanese Patent Application Laid-Open No. 2003-145783 merely illustrate measurement results of specific relative humidities when using the holder for keeping the relative humidity 60% RH or more. Japanese Patent Application Laid-Open No. 2003-145783 is not intended to keep the relative humidity in the above range in order to prevent the dew condensation on the nozzle surface.

The presently disclosed subject matter has been made in consideration such a circumstance, and an object thereof is to provide an inkjet recording apparatus capable of preventing the nozzle surface of the inkjet head from drying and preventing the dew condensation from occurring on the nozzle surface, and a control method therefor.

In order to solve the above problem, an inkjet recording apparatus according to a first aspect of the presently disclosed subject matter includes an inkjet head having a nozzle surface on which nozzles configured to eject an ink are formed, a head housing part configured to house the inkjet head, a humidity acquiring part configured to acquire a relative humidity of the nozzle surface of the inkjet head housed in the head housing part, and a temperature and humidity regulating part configured to perform at least one of a humidification process and a dehumidification process according to the relative humidity of the nozzle surface acquired by the humidity acquiring part to set the relative humidity of the nozzle surface to 37% RH or more and 65% RH or less.

The inkjet recording apparatus according to a second aspect of the presently disclosed subject matter, in the first aspect, further includes a temperature and humidity sensor mounted in the head housing part so as to face the inkjet head, in which the humidity acquiring part calculates the relative humidity of the nozzle surface according to a temperature and humidity measured by the temperature and humidity sensor.

The inkjet recording apparatus according to a third aspect of the presently disclosed subject matter, in the first aspect, further includes an internal temperature and humidity sensor that is arranged outside the head housing part and inside the inkjet recording apparatus, and measures a temperature and humidity inside the inkjet recording apparatus, and an external temperature and humidity sensor that is arranged outside the inkjet recording apparatus, and measures a temperature and humidity outside the inkjet recording apparatus, in which the humidity acquiring part has temperature and humidity data indicating a correspondence relationship between the temperatures and humidities outside and inside the inkjet recording apparatus and a temperature and humidity of the nozzle surface, and calculates the relative humidity of the nozzle surface according to the temperatures and humidities inside and outside the inkjet recording apparatus respectively measured by the internal temperature and humidity sensor and the external temperature and humidity sensor, and the temperature and humidity data.

The inkjet recording apparatus according to a fourth aspect of the presently disclosed subject matter, in the first aspect, further includes a fixture unit to which the inkjet head is fixed, and a temperature and humidity sensor attached to the fixture unit, in which the humidity acquiring part calculates the relative humidity of the nozzle surface according to a temperature and humidity measured by the temperature and humidity sensor.

The inkjet recording apparatus according to a fifth aspect of the presently disclosed subject matter, in the fourth aspect, the temperature and humidity sensor is mounted on each of both ends of the fixture unit, and the humidity acquiring part calculates the relative humidity of the nozzle surface according to a temperature and humidity measured by the temperature and humidity sensor on each of both ends.

The inkjet recording apparatus according to a sixth aspect of the presently disclosed subject matter, in any one of the first to fifth aspects, the temperature and humidity regulating part performs the humidification process on the nozzle surface in a case where the relative humidity of the nozzle surface acquired by the humidity acquiring part becomes less than 37% RH, or becomes equal to or less than a first threshold that is larger than 37% RH, and performs the dehumidification process on the nozzle surface in a case where the relative humidity of the nozzle surface acquired by the humidity acquiring part becomes larger than 65% RH, or becomes equal to or more than a second threshold that is less than 65% RH.

The inkjet recording apparatus according to a seventh aspect of the presently disclosed subject matter, in the sixth aspect, the head housing part holds a wetting liquid, and the temperature and humidity regulating part regulates at least one of a temperature of or an amount of the wetting liquid to perform the humidification process or the dehumidification process.

The inkjet recording apparatus according to an eighth aspect of the presently disclosed subject matter, in the sixth or seventh aspect, the temperature and humidity regulating part adjusts a distance between the nozzle surface and the head housing part to perform the humidification process or the dehumidification process.

The inkjet recording apparatus according to a ninth aspect of the presently disclosed subject matter, in any one of the sixth to eighth aspects, further includes a fan that is provided to the head housing part and is configured to blow an air, in which the temperature and humidity regulating part blows an air to the nozzle surface by use of the fan to perform the dehumidification process.

The inkjet recording apparatus according to a tenth aspect of the presently disclosed subject matter, in any one of the first to ninth aspects, while the inkjet head is housed in the head housing part, in a case where the relative humidity of the nozzle surface acquired by the humidity acquiring part becomes less than 37% RH, or becomes larger than 65% RH, a maintenance process is performed before the inkjet head carries out recording.

A control method for the inkjet recording apparatus according to an eleventh aspect of the presently disclosed subject matter includes a head housing step of housing in a head housing part an inkjet head having a nozzle surface on which nozzles configured to eject an ink are formed, a humidity acquiring step of acquiring a relative humidity of the nozzle surface of the inkjet head housed in the head housing part, and a temperature and humidity regulating step of performing at least one of a humidification process and a dehumidification process according to the relative humidity of the nozzle surface acquired in by the humidity acquiring step to set the relative humidity of the nozzle surface to 37% RH or more and 65% RH or less.

According to the presently disclosed subject matter, by keeping the relative humidity of the nozzle surface (or the vicinity thereof) in a range of 37% RH or more and 65% RH or less, both ejection defection caused by drying of the nozzle surface and ejection defection caused by the dew condensation can be prevented from occurring.

BRIEF DESCRIPTION OF THE DRAWINGS

FIG. 9 is a cross-sectional view illustrating a state during a capping period (when a head is retained in a wetting state) or during a print stand-by period, in a power-off state or the like;

DETAILED DESCRIPTION OF THE EMBODIMENTS

Hereinafter, a description is given of embodiments of an inkjet recording apparatus and a control method therefor according to the presently disclosed subject matter in accordance with the accompanying drawings.

[Configuration Example of Inkjet Recording Apparatus]

Figure 1:
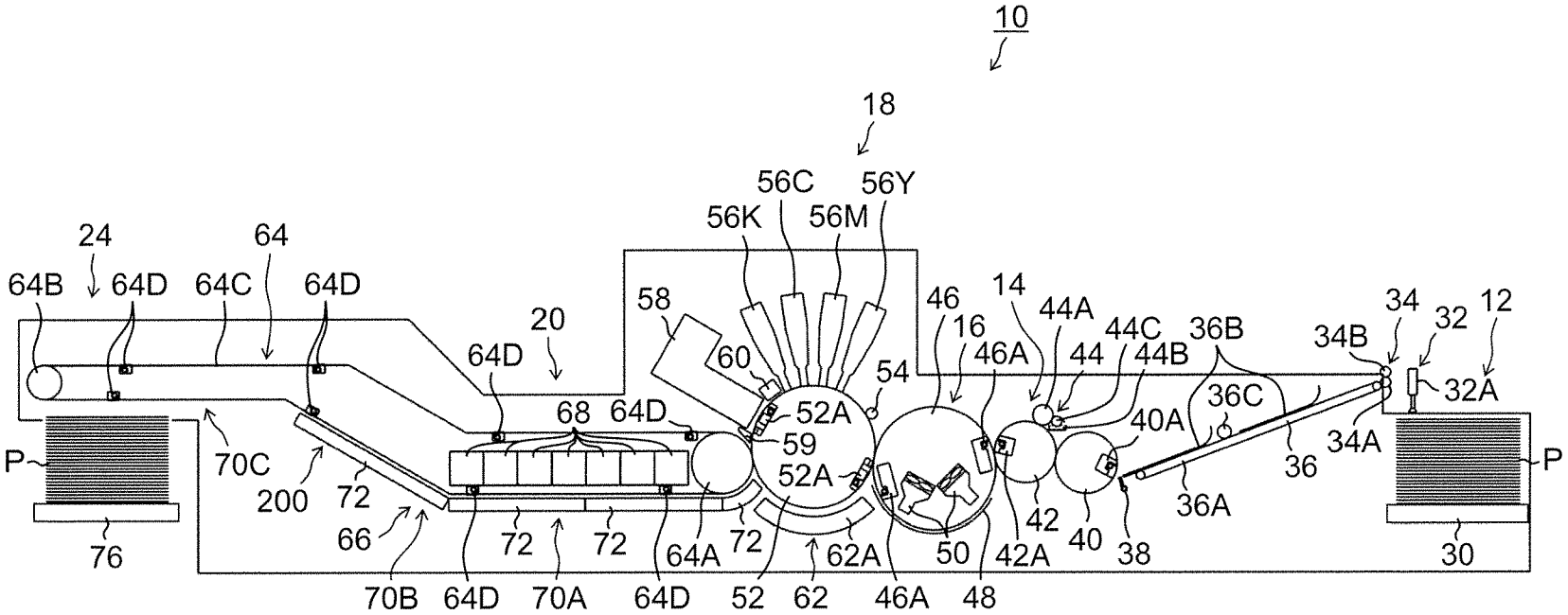
FIG. 1 is a configuration diagram of an inkjet recording apparatus according to an embodiment of the presently disclosed subject matter.

Firstly, a description is given of a configuration of an inkjet recording apparatus as a liquid ejection apparatus to which the presently disclosed subject matter is to be applied. FIG. 1 is a configuration diagram of an inkjet recording apparatus according to an embodiment of the presently disclosed subject matter.

An inkjet recording apparatus 10 according to the embodiment uses an aqueous pigment ink (that is an ink containing a coloring pigment dispersed in an aqueous solvent) to record an image on a cut paper sheet (recording medium) P by means of inkjet printing. As illustrate in FIG. 1, the inkjet recording apparatus 10 includes a paper feed section 12 for feeding the paper sheet P, a treatment liquid applying section 14 for applying a predetermined treatment liquid on a surface (image recording surface) of the paper sheet P which has been fed from the paper feed section 12, a treatment liquid drying treatment section 16 for performing a drying treatment on the paper sheet P on which the treatment liquid has been applied by the treatment liquid applying section 14, an image recording section 18 for recording an image by means of inkjet printing using an aqueous pigment ink on the surface of the paper sheet P which has been subjected to the drying treatment by the treatment liquid drying treatment section 16, an ink drying treatment section 20 for performing a drying treatment on the paper sheet P on which the image has been recorded by the image recording section 18, and a paper output section 24 for stacking thereon the paper sheet P output after subjected to all treatments. Then, conveyance of the paper sheet P from the paper feed section 12 to the paper output section 24 is performed by a later described conveying section which is constituted by a drum-shaped conveying device and a chain gripper-shaped conveying device.

<Paper Feed Section>

The paper feed section 12 feeds the paper sheet S stacked on the paper feed platform 30 one by one to the treatment liquid applying section 14. The paper feed section 12 includes the paper feed platform 30, a sucker device 32, a paper feed roller pair 34, a feeder board 36, a front stop 38, and a paper feed drum 40.

The paper sheets P are put on the paper feed platform 30 in a stack of many sheets of paper. The paper output platform 30 is provided so as to be able to be lifted and lowered by means of a paper feed platform lifting and lowering device not illustrated in the figure. The paper feed platform lifting and lowering device is controlled to be driven in conjunction with increase or decrease of the paper sheets P stacked on the paper feed platform 30 to lift and lower the paper feed platform 30 such that the paper sheet P placed on the top of the stack is always positioned at a certain height.

The paper sheet P as a recording medium is not specifically limited, but may be general purpose print paper sheet used for general offset printing (paper sheet mainly made of cellulose such as so-called high-quality paper, coat paper, art paper or the like). In the example, coated paper is used. The coated paper is one generally having a coat layer given thereon by applying a coating material on a surface of non-surface treated high-quality paper, acid-free paper or the like. Specifically, there are preferably used art paper, coat paper, lightweight coat paper, fine coating paper and the like.

The sucker device 32 sequentially takes up the paper sheets P stacked on the paper feed platform 30 from the top thereof one by one to feed to the paper feed roller pair 34. The sucker device 32 includes a suction foot 32A which is liftably and swingably provided, and transports the paper sheet P from the paper feed platform 30 to the paper feed roller pair 34 with an upper surface of the paper sheet P being held by suction by the suction foot 32A. At this time, the suction foot 32A holds by suction the upper surface on a leading end side of the paper sheet P placed on the top of the stack to lift the paper sheet P, and inserts the leading end of the lifted paper sheet P between a pair of rollers 34A and 34B constituting the paper feed roller pair 34.

The paper feed roller pair 34 is constituted by the vertical pair of rollers 34A and 34B which are pressed to and brought into contact with each other. In the vertical pair of rollers 34A and 34B, one of which is a driving roller (roller 34A) and the other is a driven roller (roller 34B), the driving roller (roller 34A) is driven by a motor not illustrated to rotate. The motor is driven in conjunction with feeding the paper sheet P to rotate the driving roller (roller 34A) at a timing when the paper sheet P is fed from the sucker device 32. The paper sheet P inserted between the vertical pair of rollers 34A and 34B is nipped by the rollers 34A and 34B and forwarded in a rotation direction of the rollers 34A and 34B (in a direction that the feeder board 36 is located).

The feeder board 36, which is formed corresponding to a width of the paper sheet, receives the paper sheet P forwarded from the paper feed roller pair 34 and guides the received sheet P to the front stop 38. The feeder board 36 is provided to be inclined with its leading end side being directed downward, and guides and slides along its conveying surface the paper sheet P placed on the conveying surface to the front stop 38.

The feeder board 36 has a plurality of tape feeders 36A provided thereon in a width direction at an interval for conveying the paper sheet P. The tape feeder 36A, which is formed to be endless, is driven by a motor not illustrated to rotate. The paper sheet P placed on the conveying surface of the feeder board 36 is conveyed over the feeder board 36 by the tape feeder 36A.

On the feeder board 36, a retainer 36B and a roller 36C are provided.

A plurality of retainers 36B (two retainers in this example) are arranged longitudinally in a back and forth direction along the conveying surface for the paper sheet P. The retainer 36B includes a leaf spring having a width corresponding to a paper sheet width, and the leaf spring is pressed to and brought into contact with the conveying surface of the feeder board 36. The paper sheet P conveyed over the feeder board 36 by the tape feeder 36A is corrected in irregularity in a course of passing through the retainer 36B. Note that the retainer 36B has a rearward end curled toward a side opposite to the conveying surface of the feeder board 36 to allow the paper sheet P to be easily introduced between the retainer 36B and the feeder board 36.

The roller 36C is arranged between the front and rear retainers 36B. The roller 36C is provided to be pressed to and brought into contact with the conveying surface for the paper sheet P. The paper sheet P conveyed between the front and rear retainers 36B is conveyed with its upper surface being held by the roller 36C.

The front stop 38 corrects an attitude of the paper sheet P. The front stop 38, which is formed into a plate, is arranged to be perpendicular to a conveying direction of the paper sheet P. The front stop 38 is provided to be swingable by being driven by a motor not illustrated. The paper sheet P conveyed over the feeder board 36 abuts on the front stop 38 at its leading end to be corrected in attitude (so-called skew prevention). The front stop 38 swings in conjunction with feeding the paper sheet to the paper feed drum 40 and transfers the paper sheet P corrected in attitude to the paper feed drum 40.

The paper feed drum 40 receives the paper sheet P fed from the feeder board 36 via the front stop 38 to convey to the treatment liquid applying section 14. The paper feed drum 40, which is formed into a cylindrical shape, is driven by a motor not illustrated to rotate. The paper feed drum 40 has a gripper 40A provided on an outer circumferential surface thereof, and the gripper 40A grips the leading end of the paper sheet P. The paper feed drum 40 rotates while gripping the leading end of the paper sheet P by the gripper 40A such that the paper sheet P is wrapped on its circumferential surface, while conveying the paper sheet P to the treatment liquid applying section 14.

The paper feed section 12 is configured as described above. This configuration allows the paper sheets P stacked on the paper feed platform 30 to be sequentially lifted from the top thereof one by one by the sucker device 32 and fed to the paper feed roller pair 34. The paper sheet P fed to the paper feed roller pair 34 is forwarded frontward to be placed on the feeder board 36 by the vertical pair of rollers 34A and 34B which constitute the paper feed roller pair 34. The paper sheet P placed on the feeder board 36 is conveyed by the tape feeder 36A provided on the conveying surface of the feeder board 36. Then, the paper sheet P is, in its conveying course, pressed against the conveying surface of the feeder board 36 by the retainer 36B to be corrected in irregularity. The paper sheet P conveyed by the feeder board 36 abuts on the front stop 38 at the leading end thereof to be corrected in inclination, and thereafter, is transferred to the paper feed drum 40. Then, the paper sheet P is conveyed by the paper feed drum 40 to the treatment liquid applying section 14.

<Treatment Liquid Applying Section>

The treatment liquid applying section 14 applies a predetermined treatment liquid onto the surface of the paper sheet P (image recording surface). This treatment liquid applying section 14 includes a treatment liquid applying drum 42 for conveying the paper sheet P, and a treatment liquid applying unit 44 for applying a predetermined treatment liquid onto a surface-to-be-printed of the paper sheet P conveyed by the treatment liquid applying drum 42.

The treatment liquid applying drum 42 receives the paper sheet P from the paper feed drum 40 in the paper feed section 12 and conveys the paper sheet P to the treatment liquid drying treatment section 16. The treatment liquid applying drum 42, which is formed into a cylindrical shape, is driven by a motor not illustrated to rotate. The treatment liquid applying drum 42 has a gripper 42A provided on an outer circumferential surface thereof, and the gripper 42A grips the leading end of the paper sheet P. The treatment liquid applying drum 42 rotates while gripping the leading end of the paper sheet P by the gripper 42A such that the paper sheet P is wrapped on its circumferential surface, while conveying the paper sheet P to the treatment liquid drying treatment section 16 (one paper sheet P is conveyed in one rotation). The treatment liquid applying drum 42 and the paper feed drum 40 are controlled to be rotated so as to match their timings of receiving and transferring the paper sheet P. In other words, the drums 42 and 40 are driven at the same peripheral velocity and driven such that their gripper positions match.

The treatment liquid applying unit 44 applies the treatment liquid by means of roller coating onto the surface of the paper sheet P conveyed by the treatment liquid applying drum 42. The treatment liquid applying unit 44 includes a coating roller 44A configured to coat the paper sheet P with the treatment liquid, a treatment liquid bath 44B configured to reserve the treatment liquid, and a pump-up roller 44C configured to pump up the treatment liquid reserved in the treatment liquid bath 44B to supply to the coating roller 44A. The pump-up roller 44C is provided to be pressed to and brought into contact with the coating roller 44A, and a part of the pump-up roller 44C is immersed in the treatment liquid reserved in the treatment liquid bath 44B. The pump-up roller 44C measures and draws up the treatment liquid to apply the treatment liquid onto a circumferential surface of the coating roller 44A at a certain thickness. The coating roller 44A is provided corresponding to the paper sheet width, and is pressed to and brought into contact with the paper sheet P to coat the paper sheet P with the treatment liquid which is applied onto the circumferential surface of the roller 44A. The coating roller 44A is driven by an abutting and separating mechanism not illustrated in the figure to move between an abutting position at which the roller 44A abuts the circumferential surface of the treatment liquid applying drum 42 and a separating position at which the roller 44A separates from the circumferential surface of the treatment liquid applying drum 42. The abutting and separating mechanism moves the coating roller 44A at a timing when the paper sheet P passes therethrough to apply the treatment liquid onto the surface of the paper sheet P conveyed by the treatment liquid applying drum 42.

Note that this example illustrates the configuration in which the treatment liquid is applied by means of roller coating, but a method for applying the treatment liquid is not limited only thereto. Besides this, a configuration may be adopted in which the treatment liquid is applied using the inkjet head or by way of spraying.

The treatment liquid applying section 14 is configured as described above. This configuration allows the paper sheet P transferred from the paper feed drum 40 in the paper feed section 12 to be received by the treatment liquid applying drum 42. The treatment liquid applying drum 42 rotates while gripping the leading end of the paper sheet P by the gripper 42A such that the paper sheet P is wrapped on its circumferential surface thereof, and covey the sheet P. In this conveying course, the coating roller 44A is pressed to and brought into contact with the surface of the paper sheet P to coat the surface of the paper sheet P with the treatment liquid.

Here, the treatment liquid coated on the surface of the paper sheet P is the treatment liquid having a function to aggregate a coloring material in the aqueous pigment ink which is deposited on the paper sheet P by the image recording section 18 at a later stage. By coating the surface of the paper sheet P with such a treatment liquid for depositing the ink, high quality printing is enabled with no landing interference occurring even if a general purpose print paper sheet is used.

<Treatment Liquid Drying Treatment Section>

The treatment liquid drying treatment section 16 subjects the paper sheet P applied with the treatment liquid to the drying treatment. The treatment liquid drying treatment section 16 includes a treatment liquid drying treatment drum 46 for conveying the paper sheet P, a paper sheet conveying guide 48, and a treatment liquid drying treatment unit 50 for blowing a hot air to the surface-to-be-printed of the paper sheet P conveyed by the treatment liquid drying treatment drum 46 to dry the surface.

The treatment liquid drying treatment drum 46 receives the paper sheet P from the treatment liquid applying drum 42 in the treatment liquid applying section 14 and conveys the paper sheet P to the image recording section 18. The treatment liquid drying treatment drum 46, which is configured to have the frame body formed into a cylindrical shape, is driven by a motor not illustrated to rotate. The treatment liquid drying treatment drum 46 has a gripper 46A provided on an outer circumferential surface thereof, and the gripper 46A grips the leading end of the paper sheet P. The treatment liquid drying treatment drum 46 rotates while gripping the leading end of the paper sheet P by the gripper 46A to convey the paper sheet P to the image recording section 18.

Note that the treatment liquid drying treatment drum 46 in the example includes the grippers 46A arranged at two positions on the outer circumferential surface thereof and is configured such that two paper sheets P can be conveyed in one rotation. The treatment liquid drying treatment drum 46 and the treatment liquid applying drum 42 are controlled to be rotated so as to match their timings of receiving and transferring the paper sheet P. In other words, the drums 46 and 42 are driven at the same peripheral velocity and driven such that their gripper positions match.

The paper sheet conveying guide 48 is arranged along a conveying path for the paper sheet P by way of the treatment liquid drying treatment drum 46 to guide the conveyance of the paper sheet P.

The treatment liquid drying treatment unit 50, which is provided inside the treatment liquid drying treatment drum 46, blows an air (hot air) heated to have a temperature equal to or more than an ambient temperature toward the surface of the paper sheet P conveyed by the treatment liquid drying treatment drum 46 to perform the drying treatment. The example illustrates the configuration in which two treatment liquid drying treatment units 50 are provided inside the treatment liquid drying treatment drum and the hot air is blown toward the surface of the paper sheet P conveyed by the treatment liquid drying treatment drum 46.

The treatment liquid drying treatment section 16 is configured as described above. This configuration allows the paper sheet P transferred from the treatment liquid applying drum 42 in the treatment liquid applying section 14 to be received by the treatment liquid drying treatment drum 46. The treatment liquid drying treatment drum 46 rotates while gripping the leading end of the paper sheet P by the gripper 46A to convey the paper sheet P. At this time, the treatment liquid drying treatment drum 46 conveys the sheet P with the surface of the paper sheet P (the surface coated with the treatment liquid) being directed inward. The paper sheet P, in a course of being conveyed by the treatment liquid drying treatment drum 46, is blown with the hot air from the treatment liquid drying treatment unit 50 provided inside the treatment liquid drying treatment drum 46 to be subjected to the drying treatment. This removes the solvent component in the treatment liquid to form an ink aggregation layer on the surface of the paper sheet P.

<Image Recording Section>

The image recording section 18 deposits droplets of each color ink (aqueous pigment ink) of C (Cyan), M (Magenta), Y (Yellow), and K (Black (Key Plate)) on the surface-to-be-printed of the paper sheet P to carry out image forming of a color image on the surface-to-be-printed of the paper sheet P. The image recording section 18 includes an image recording drum 52 for conveying the paper sheet P, a paper sheet pressing roller 54 for pressing the paper sheet P conveyed by the image recording drum 52 to bring the paper sheet P into tight contact with a circumferential surface of the image recording drum 52, inkjet heads 56C, 56M, 56Y, and 56K for ejecting the ink droplets of respective colors of C, M, Y, and K to the paper sheet P, an inline sensor 58 for reading the image recorded on the paper sheet P, a mist filter 60 for catching ink mist, and a drum cooling unit 62.

The image recording drum 52 receives the paper sheet P from the treatment liquid drying treatment drum 46 in the treatment liquid drying treatment section 16 and conveys the paper sheet P to the ink drying treatment section 20. The image recording drum 52, which is formed into a cylindrical shape, is driven by a motor not illustrated to rotate. The image recording drum 52 has a gripper 52A provided on an outer circumferential surface thereof, and the gripper 52A grips the leading end of the paper sheet P. The image recording drum 52 rotates while gripping the leading end of the paper sheet P by the gripper 52A such that the paper sheet P is wrapped on its circumferential surface, while conveying the paper sheet P to ink drying treatment section 20. The image recording drum 52 has many suction holes (not illustrated) formed on a circumferential surface thereof in a predetermined pattern. The paper sheet P wrapped on the circumferential surface of the image recording drum 52 is held and conveyed while being suctioned from the suction holes by suction on the circumferential surface of the image recording drum 52. This allows the paper sheet P to be conveyed with flatness being highly maintained.

Note that the suction from the suction holes acts only on a certain range, specifically, acts between a predetermined suction start position and a predetermined suction end position. The suction start position is set to an installation position of the paper sheet pressing roller 54 and the suction end position is set on the downstream side of an installation position of the inline sensor 58 (for example, set to a position at which the paper sheet is transferred to the ink drying treatment section 20). In other words, the suction start and end positions are set so that the paper sheet P is held by suction on the circumferential surface of the image recording drum 52 at least at installation positions of the inkjet heads 56C, 56M, 56Y, and 56K (image recording positions) and the installation position of the inline sensor 58 (image reading position).

Note that a mechanism to hold the paper sheet P by suction on the circumferential surface of the image recording drum 52 is not limited to the above suction method using a negative pressure, but may adopt a method using electrostatic adsorption.

The image recording drum 52 in the example has two grippers 52A arranged at two positions on the outer circumferential surface thereof and is configured such that two paper sheets P can be conveyed in one rotation. The image recording drum 52 and the treatment liquid drying treatment drum 46 are controlled to be rotated so as to match their timings of receiving and transferring the paper sheet P. In other words, the drums 52 and 46 are driven at the same peripheral velocity and driven such that their gripper positions match.

The paper sheet pressing roller 54 is provided in the vicinity of a paper sheet receiving position on the image recording drum 52 (a position at which the paper sheet P is received from the treatment liquid drying treatment drum 46). The paper sheet pressing roller 54, which is constituted by a rubber roller, is provided to be pressed to and brought into contact with the circumferential surface of the image recording drum 52. The paper sheet P transferred from the treatment liquid drying treatment drum 46 to the image recording drum 52 is nipped in a course of passing through the paper sheet pressing roller 54 to be bought into tight contact with the circumferential surface of the image recording drum 52.

Four inkjet heads 56C, 56M, 56Y, and 56K are arranged at a certain interval along the conveying path for the paper sheet P by way of the image recording drum 52. The inkjet heads 56C, 56M, 56Y, and 56K are configured of a line head corresponding to the paper sheet width and arranged such that a nozzle surface faces the circumferential surface of the image recording drum 52. The respective inkjet heads 56C, 56M, 56Y, and 56K eject the ink droplets from a nozzle alignment formed on the nozzle surface toward the image recording drum 52 to record an image on the paper sheet P conveyed by the image recording drum 52.

Note that, as described above, the aqueous pigment ink is used for the ink ejected from each of the inkjet heads 56C, 56M, 56Y, and 56K. The aqueous pigment ink can made to react with the treatment liquid applied by the treatment liquid applying section 14 to aggregate the coloring pigment in the aqueous pigment ink.

Examples of the aqueous pigment ink may include those having a composition as below, for example. Table 1 illustrates only a composition of a black aqueous pigment ink, but a composition of other color may be those using cyan, magenta, or yellow pigment in place of the black pigment.

TABLE 1

| COMPOSITION OF INK (BLACK AQUEOUS PIGMENT INK) | |
|---|---|
| BLACK PIGMENT (CARBON BLACK) | 4% |
| PIGMENT DISPERSANT (POLYMERIC DISPERSANT P-1) | 2% |
| SANNIX (REGISTERED TRADEMARK) GP-250 (MADE BY SANYO CHEMICAL INDUSTRIES, LTD.) | 10% |
| TRIPROPYLENE GLYCOL MONOMETHYL ETHER | 5% |
| OLFINE (REGISTERED TRADEMARK) E1010 (MADE BY NISSIN CHEMICAL INDUSTRY CO., LTD) | 0.5% |
| OLFINE (REGISTERED TRADEMARK) E1020 (MADE BY NISSIN CHEMICAL INDUSTRY CO., LTD) | 1% |
| SELF-DISPERSING POLYMER PARTICLES (B-01) | 8% |
| BYK (REGISTERED TRADEMARK)-024 (POLYSILOXANE ANTIFOAM AGENT) | 0.01% |
| WATER | 69.49% |

<Configuration Example of Inkjet Head>

Figure 2:
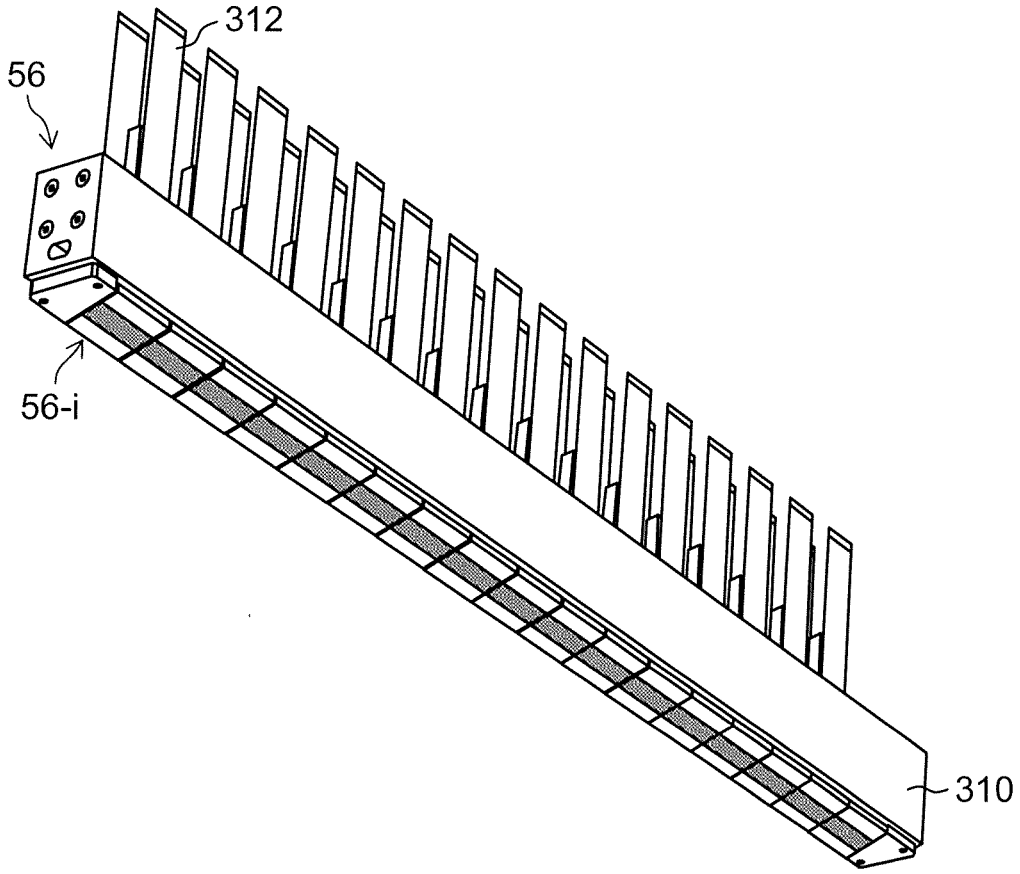
FIG. 2 is a perspective view of an inkjet head according to the embodiment of the presently disclosed subject matter.

FIG. 2 is a perspective view of an inkjet head according to the embodiment of the presently disclosed subject matter. FIG. 2 illustrates a view of a nozzle surface 56A upwardly seen from underneath the head 56 (obliquely underneath).

As illustrated in FIG. 2, the head 56 is a full-line type line head (single-pass printing page-wide head) in which plural head modules 56-*i* (n head modules, n is an integer equal to or more than 2) (i=1, 2 . . . n) are aligned and joined in the paper sheet width direction to be lengthened. An ink ejecting surface of the head 56 has the nozzle alignment formed thereon in which multiple ink ejecting nozzles are arrayed over the entire width of an image forming area. Reference numeral 310 designates a housing as a frame body for fixing the plural head modules 56-*i* (housing for configuring a bar-shaped line head), and reference numeral 312 designates a flexible substrate connected with each of head modules 56-*i*.

Here, an example is shown in which 17 head modules 56-*i* are joined, but a configuration of the module, the number of the modules, and an array format of the modules are not limited to the shown example.

Figure 3:
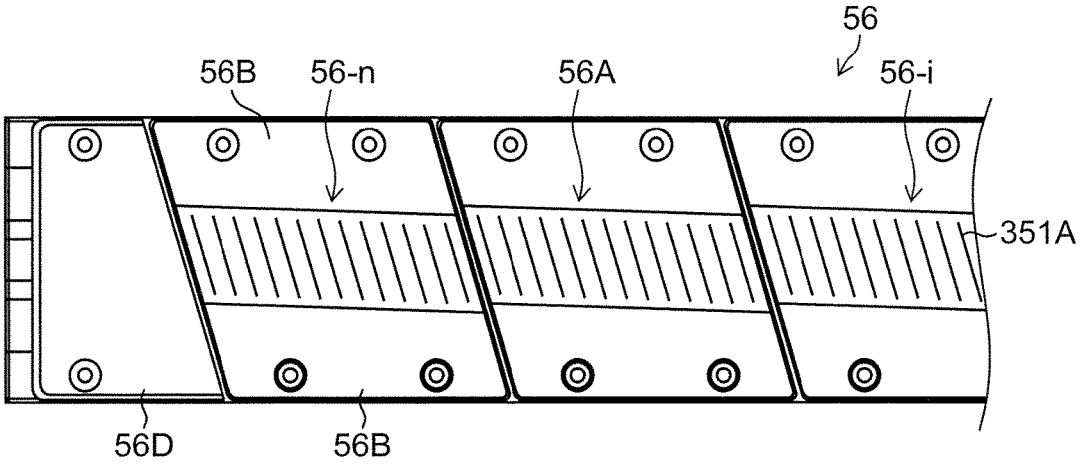
FIG. 3 is a partial enlarged view of a head seen from a nozzle surface side.

FIG. 3 is a partial enlarged view of the head 56 seen from the side of the nozzle surface 56A.

Each head module 56-*i* is supported by head module supporting members 56B from both sides in a short-side direction of the head 56. Both ends in a longitudinal direction of the head 56 are supported by head supporting members 56D.

Each head module 56-*i* (the nth head module 56-*n*) has a configuration in which plural nozzles are arrayed in a matrix. Oblique solid lines designated by reference numeral and character 351A illustrated in FIG. 3 represent the nozzle alignment in which the plural nozzles are aligned in a line.

<Ejection Method>

A device which generates an ejection pressure (ejection energy) for ejecting liquid droplets from the nozzles in the inkjet head may adopt various pressure generating elements (ejection energy generating elements), such as a piezoelectric actuator (piezoelectric element), a static actuator, a heater (heating element) in a thermal method (method of ejecting ink by using a pressure due to film boiling upon heating by a heater), or various kinds of actuators of other methods. A corresponding energy generating element is provided in a flow channel structure in accordance with the ejection method of the head.

The paper sheet P is conveyed at a uniform speed by the image recording drum 52 and an operation is performed only one time of moving the paper sheet P and the respective head 56Y, 56M, 56C, and 56K relatively in the conveying direction (that is, one time sub-scanning), which makes it possible to record an image on the image forming area of the paper sheet P.

Here, the inkjet recording apparatus 10 is shown which uses the inks of four colors CMYK, but ink colors, a combination of colors, and an order to arrange the heads of the respective colors are not limited to the embodiment.

The inline sensor 58, which is arranged on the downstream side of the inkjet head 56K that is on the last location in the conveying direction of the paper sheet P by way of the image recording drum 52, reads the image recorded by the inkjet heads 56C, 56M, 56Y, and 56K. The inline sensor 58 is configured of, for example, a line scanner, and reads the image, which is recorded by inkjet heads 56C, 56M, 56Y, and 56K, from the paper sheet P conveyed by the image recording drum 52.

On the basis of an imaging result by the inline sensor 58, an image failure detecting part (not illustrated) detects an image failure. As the "image failure" referred here, there may be considered those caused by ejection abnormality of the inkjet heads 56C, 56M, 56Y, and 56K, such as a streak caused by ejection bending of the ink from the inkjet head. Examples of the image failure may include those caused by color deviation, and those caused by a foreign matter smeared such as ink mist.

Note that the image failure may be an abnormality on the paper sheet P which can be grasped from the imaging result by the inline sensor 58, and is not limited to those described above. In combination with or in place of the inline sensor 58, a sensor for detecting dirt of the paper sheet P (dirt detecting part) may be separately provided.

The examples illustrates, as a failure detecting device, a way of utilizing the imaging result by the inline sensor 58 configured of the line scanner, but the presently disclosed subject matter is not limited thereto.

For example, an aspect may be possible which includes, besides the inline sensor 58, an imaging device (high speed camera) directly imaging ejection states of ink of the inkjet heads 56C, 56M, 56Y, and 56K.

On the downstream side of the inline sensor 58, a contact preventing plate 59 is provided in proximity to the inline sensor 58. The contact preventing plate 59 prevents the paper sheet P from having contact with the inline sensor 58 in a case where failure in conveyance or the like causes the paper sheet P to come off The mist filter 60, which is arranged between the inkjet head 56K that is on the last location and the inline sensor 58, suctions air around the image recording drum 52 to catch the ink mist. In this way, by suctioning the air around the image recording drum 52 to catch the ink mist, the ink mist can be prevented from entering the inline sensor 58 to prevent the failure in reading or the like from occurring.

The drum cooling unit 62 blows a temperature-regulated air (cold air) to the image recording drum 52 to cool the image recording drum 52. The drum cooling unit 62 includes an air conditioner (not illustrated) and a duct 62A for blowing the cold air supplied from the air conditioner to the circumferential surface of the image recording drum 52. The duct 62A blows the cold air to the image recording drum 52 except for a conveying area for the paper sheet P to cool the image recording drum 52. The example illustrates a configuration in which the paper sheet P is conveyed along a circumferential arc surface of a substantially upper half of the image recording drum 52 so that the duct 62A blows the cold air to a substantially lower half area of image recording drum 52 to cool the image recording drum 52. Specifically, the configuration is such that a blowing outlet of the duct 62A is formed into an arc shape so as to cover a substantially lower half of the image recording drum 52, and the substantially lower half area of the image recording drum 52 is blown with the cold air.

Here, the temperature for cooling the image recording drum 52 is defined depending on a relationship with between a temperature of the inkjet heads 56C, 56M, 56Y, and 56K (particularly, a temperature of the nozzle surface), and the cooling is performed such that the image recording drum 52 may have a temperature lower than that of the inkjet heads 56C, 56M, 56Y, and 56K. This can prevent the dew condensation from occurring on the inkjet heads 56C, 56M, 56Y, and 56K. In other words, decreasing the temperature of the image recording drum 52 lower than the inkjet heads 56C, 56M, 56Y, and 56K can induce the dew condensation on the image recording drum side, which can prevent the dew condensation from occurring on the inkjet heads 56C, 56M, 56Y, and 56K (particularly, the dew condensation to occur on the nozzle surface).

The image recording section 18 is configured as described above. This configuration allows the paper sheet P transferred from the treatment liquid drying treatment drum 46 in the treatment liquid drying treatment section 16 to be received by the image recording drum 52. The image recording drum 52 rotates while gripping the leading end of the paper sheet P by the gripper 52A to convey the paper sheet P. The paper sheet P transferred to the image recording drum 52 is firstly bought into tight contact with the circumferential surface of the image recording drum 52 in a course of passing through the paper sheet pressing roller 54. At the same time as this, the sheet P is suctioned from the suction holes on the image recording drum 52 to be held by suction on the outer circumferential surface of the image recording drum 52. The paper sheet P is conveyed in this state and passes through the respective inkjet heads 56C, 56M, 56Y, and 56K. Then, in the course of that passing through, the ink droplets of the respective colors of C, M, Y, and K are deposited on the surface of the sheet P from the respective inkjet heads 56C, 56M, 56Y, and 56K to carry out image forming of a color image on the relevant surface. Since the ink aggregation layer is formed on the surface of the paper sheet P, a high quality image can be recorded without feathering or bleeding.

Next, the paper sheet P on which the image has been recorded by the inkjet heads 56C, 56M, 56Y, and 56K passes through the inline sensor 58. Then, the image recorded on the surface is read in a course of passing through the inline sensor 58. The reading of the recorded image is carried out for all paper sheets P. In the reading, the reading is carried out in a state that the sheet P is held by suction on the image recording drum 52, allowing highly accurate reading. Since the reading is carried out immediately after the image is recorded, for example, abnormality such as ejection defection can be promptly detected and a measure against that can be swiftly taken. This can prevent the record from being performed in vain and minimize waste sheet.

After that, the paper sheet P after released from the suction is transferred to the ink drying treatment section 20.

<Ink Drying Treatment Section>

The ink drying treatment section 20 subjects the paper sheet P after the image is recorded to the drying treatment to remove a liquid component remaining on the surface of the paper sheet P. The ink drying treatment section 20 includes a chain gripper 64 for conveying the paper sheet P on which the image has been recorded, a back tension applying mechanism 66 for applying back tension to the paper sheet P conveyed by the chain gripper 64, and an ink drying treatment unit 68 for subjecting the paper sheet P conveyed by the chain gripper 64 to the drying treatment.

The chain gripper 64, which is a paper sheet conveying mechanism used in common for the ink drying treatment section 20 and the paper output section 24, receives the paper sheet P transferred from the image recording section 18 to convey to the paper output section 24.

The chain gripper 64 includes first sprockets 64A arranged in proximity to image recording drum 52, second sprockets 64B arranged in the paper output section 24, endless chains 64C wound around the first sprockets 64A and the second sprockets 64B, plural chain guides (not illustrated) for guiding travel of the chain 64C, and plural grippers 64D attached to the chain 64C at a certain interval. The first sprockets 64A, the second sprockets 64B, the chains 64C, and the chain guides are respectively formed into a pair and arranged on both sides of the paper sheet P in the width direction. The plural grippers 64D, which are arranged between the pair of the chains 64C, grip both end sides of a leading end edge of the paper sheet P (illustrated in FIG. 2 designated by reference numeral and character P1).

The first sprocket 64A is arranged in proximity to the image recording drum 52 so as to be able to receive the paper sheet P transferred from the image recording drum 52 by the plural grippers 64D. The first sprocket 64A is rotatably provided with being journaled on a bearing not illustrated, and connected with a motor not illustrated. The chain 64C wound around the first sprocket 64A and the second sprocket 64B travels by driving this motor.

The second sprocket 64B is arranged in the paper output section 24 so as to be able to collect the paper sheet P received from the image recording drum 52 by the paper output section 24. In other words, the installation position of the second sprocket 64B is the end of the conveying path for the paper sheet P by the chain gripper 64. The second sprocket 64B is rotatably provided with being journaled on a bearing not illustrated.

The chain 64C is formed into an endless shape and wound around the first sprocket 64A and the second sprocket 64B.

The chain guides, which are arranged at predetermined positions, guides such that the chain 64C travels a predetermined path (that is, guides such that the paper sheet P travels a predetermined conveying path to be conveyed). In the inkjet recording apparatus 10 in the example, the second sprocket 64B is arranged at a position higher than that of the first sprocket 64A. For this reason, a travelling path is formed on which the chain 64C is inclined along the way. Specifically, the travelling path includes a first horizontal conveying path 70A, an inclined conveying path 70B, and a second horizontal conveying path 70C.

A height of the first horizontal conveying path 70A is set to the same height as the first sprocket 64A and set such that the chain 64C wound around the first sprocket 64A horizontally travels.

A height of the second horizontal conveying path 70C is set to the same height as the second sprocket 64B and set such that the chain 64C wound around the second sprocket 64B horizontally travels.

The inclined conveying path 70B is set between the first horizontal conveying path 70A and the second horizontal conveying path 70C and set so as to couple between the first horizontal conveying path 70A and the second horizontal conveying path 70C.

The chain guides are arranged to form the first horizontal conveying path 70A, the inclined conveying path 70B, and the second horizontal conveying path 70C. Specifically, the chain guides are arranged at at least a joining point between the first horizontal conveying path 70A and the inclined conveying path 70B and a joining point between the inclined conveying path 70B and the second horizontal conveying path 70C.

The plural pairs of grippers 64D are arranged on the chain 64C at a certain interval. The installation interval of the grippers 64D is set to match an interval for receiving the paper sheet P from the image recording drum 52. In other words, the installation interval is set to match the interval for receiving the paper sheet P from the image recording drum 52 such that the paper sheet P sequentially transferred from the image recording drum 52 can be received from the image recording drum 52 at a matched timing.

The chain grippers 64 are configured as described above. This configuration allows the chain 64C to travel when a motor (not illustrated) connected with the first sprocket 64A is driven, as described above. The chain 64C travels at the same speed as the peripheral velocity of the image recording drum 52. In addition, a timing is matched so that the paper sheet P transferred from the image recording drum 52 is received by the respective grippers 64D.

The back tension applying mechanism 66 applies the back tension to the paper sheet P conveyed with its leading end being gripped by the chain gripper 64. The back tension applying mechanism 66 includes a guide plate 72, and a suction mechanism (not illustrated) for suctioning an air from suction holes (not illustrated) formed on the guide plate 72.

The guide plate 72 is configured of a hollow box plate having a width corresponding to the paper sheet width. The guide plate 72 is arranged along the conveying path for the paper sheet P by the chain gripper 64 (that is, the travelling path of the chain). Specifically, the guide plate 72 is arranged along the chain 64C travelling the first horizontal conveying path 70A and the inclined conveying path 70B, and arranged at a predetermined distance from the chain 64C. The paper sheet P conveyed by the chain gripper 64 is conveyed with its back surface (surface on the side on which no image is recorded) being brought into sliding contact with an upper surface of the guide plate 72 (surface facing the chain 64C: sliding contact surface).

The sliding contact surface (upper surface) of the guide plate 72 has many suction holes (not illustrated) formed thereon in a predetermined pattern. The guide plate 72 is configured of a hollow box plate as described above. The suction mechanism (not illustrated) carries out suction from a hollow portion (inner side) of the guide plate 72. This allows the air to be suctioned from the suction holes formed on the sliding contact surface.

Suctioning the air from the suction holes of the guide plate 72 allows the back surface of the paper sheet P conveyed by the chain gripper 64 to be suctioned through the suction holes. This allows the back tension to be applied to the paper sheet P conveyed by the chain gripper 64.

As described above, since the guide plate 72 is arranged along the chain 64C travelling the first horizontal conveying path 70A and the inclined conveying path 70B, the back tension is applied during the travelling the first horizontal conveying path 70A and the inclined conveying path 70B.

The ink drying treatment unit 68, which is provided inside the chain gripper 64 (particularly, a portion configuring the first horizontal conveying path 70A), subjects the paper sheet P conveyed on the first horizontal conveying path 70A to the drying treatment. The ink drying treatment unit 68 performs the drying treatment by blowing the hot air to the surface of the paper sheet P conveyed on the first horizontal conveying path 70A. The plural ink drying treatment units 68 are arranged along the first horizontal conveying path 70A. The installation number of the units 68 is set depending on a treatment capacity of the ink drying treatment unit 68, a conveying speed (that is printing speed) of the paper sheet P or the like. In other words, the installation number is set so that the paper sheet P received from image recording section 18 can be dried while it is conveyed on the first horizontal conveying path 70A. Therefore, a length of the first horizontal conveying path 70A is also set in consideration of the capability of the ink drying treatment unit 68.

Note that by performing the drying treatment, the humidity in the ink drying treatment section 20 increases. Since the drying treatment cannot be efficiently performed if the humidity increases, the ink drying treatment section 20 is preferably provided with an exhausting device together with the ink drying treatment unit 68 such that a moist air generated due to the drying treatment is forced to be exhausted. The exhausting device may, for example, be configured such that an exhaust air duct is provided to the ink drying treatment section 20 and the exhaust air duct exhausts the air in ink drying treatment section 20.

The ink drying treatment section 20 is configured as described above. This configuration allows the paper sheet P transferred from the image recording drum 52 in the image recording section 18 to be received by the chain gripper 64. The chain gripper 64 grips the leading end of the paper sheet P by the grippers 64D to make the paper sheet P follow the planner guide plate 72 and conveys the sheet P. The paper sheet P transferred to the chain gripper 64 is first conveyed on the first horizontal conveying path 70A. The paper sheet P, in a course of being conveyed on the first horizontal conveying path 70A, is subjected to the drying treatment by the ink drying treatment unit 68 provided inside the chain gripper 64. In other words, the surface (image recording surface) is blown with the hot air to be subjected to the drying treatment. At this time, the paper sheet P is given the back tension by the back tension applying mechanism 66 while subjected to the drying treatment. This can perform the drying treatment with the paper sheet P being prevented from deforming.

<Paper Output Section>

The paper output section 24 collects the paper sheet P having been subjected to a series of image recording process. The paper output section 24 includes the chain gripper 64 for conveying the paper sheet P, and a paper output platform 76 for collecting the paper sheet P in a stacking manner.

As described above, the chain gripper 64 is used in common with the ink drying treatment section 20. The chain gripper 64 releases the paper sheet P above the paper output platform 76 to stack the paper sheet P on the paper output platform 76.

The paper output platform 76 collects in a stacking manner the paper sheet P released from the chain gripper 64. The paper output platform 76 is provided with sheet guides (a front sheet guide, a rear sheet guide, a side sheet guide, and the like) such that the paper sheets P are orderly stacked.

The paper output platform 76 is provided so as to be able to be lifted and lowered by means of a paper output platform lifting and lowering device not illustrated. The paper output platform lifting and lowering device is controlled to be driven in conjunction with increase or decrease of the paper sheet P stacked on the paper output platform 76 to lift and lower the paper output platform 76 such that the paper sheet P placed on the top of the stack is always positioned at a certain height.

Note that a method for moving the head 56 and the paper sheet relatively to each other is not limited to the drum conveyance method illustrated in FIG. 1, and various forms may be adopted such as a belt conveyance method, a nip conveyance method, and a pallet conveyance method.

Additionally, although not illustrated in FIG. 1, the inkjet recording apparatus 10 includes, besides the above configuration, an ink reserving/loading section for supplying an ink to each of the heads 56Y, 56M, 56C, and 56K, and a device which supplies the treatment liquid to the treatment liquid applying section 14. Further, the inkjet recording apparatus 10 includes a maintenance section for cleaning the respective heads 56Y, 56M, 56C, and 56K (wiping, purging, and nozzle sucking of the nozzle surface, or the like) or head wetting during a print stand-by period or the like (maintenance station including a wetting device 150 described later with reference to from FIG. 3 to FIG. 6 or the like), as well as a position detecting sensor for detecting a position of the paper sheet P on the paper sheet conveying path, a temperature sensor for detecting a temperature of each section or unit in the apparatus, and the like.

[Explanation of Drawing Section and Maintenance Section]

Figure 4:
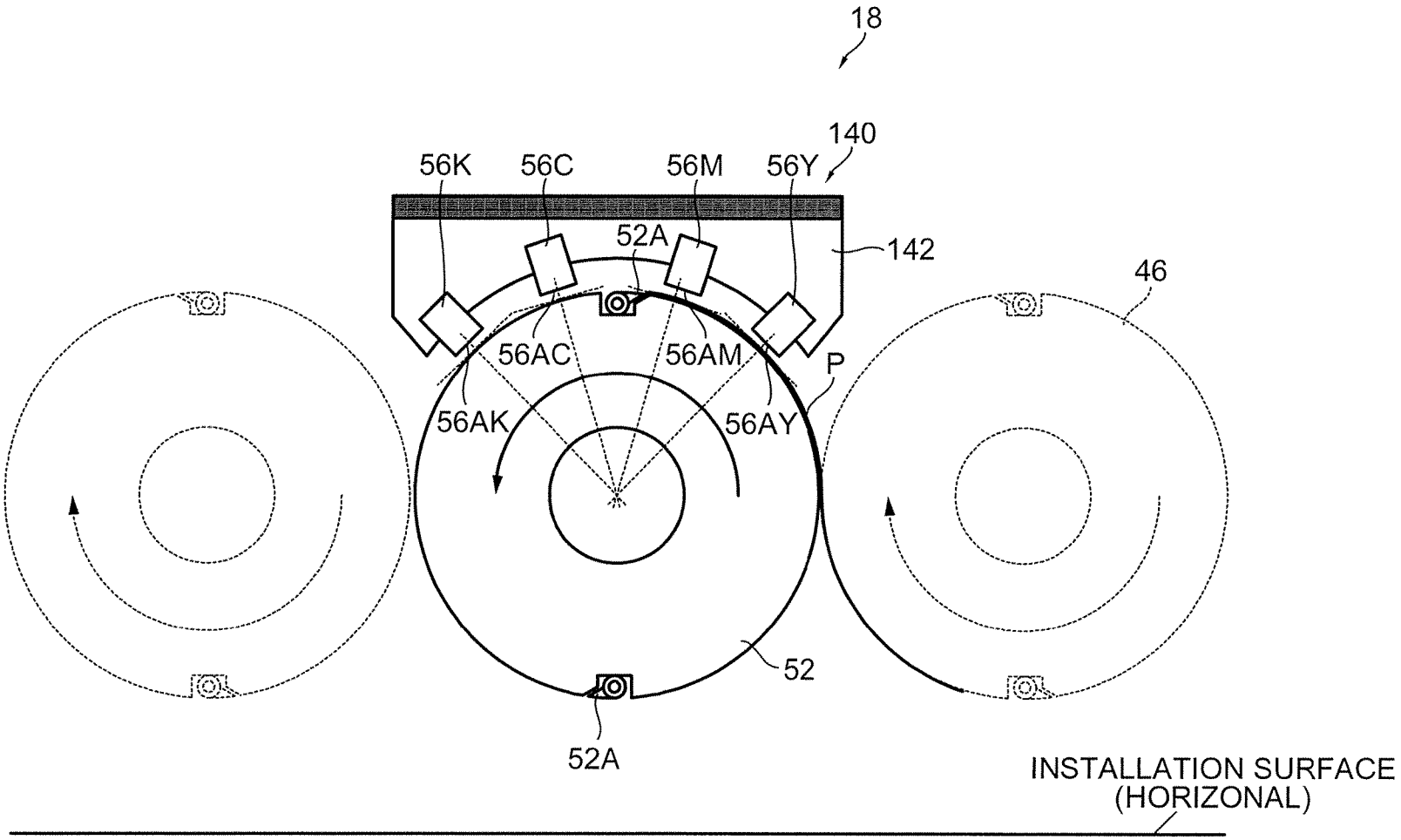
FIG. 4 is a lateral view illustrating a schematic configuration of a drawing section.
Figure 5:
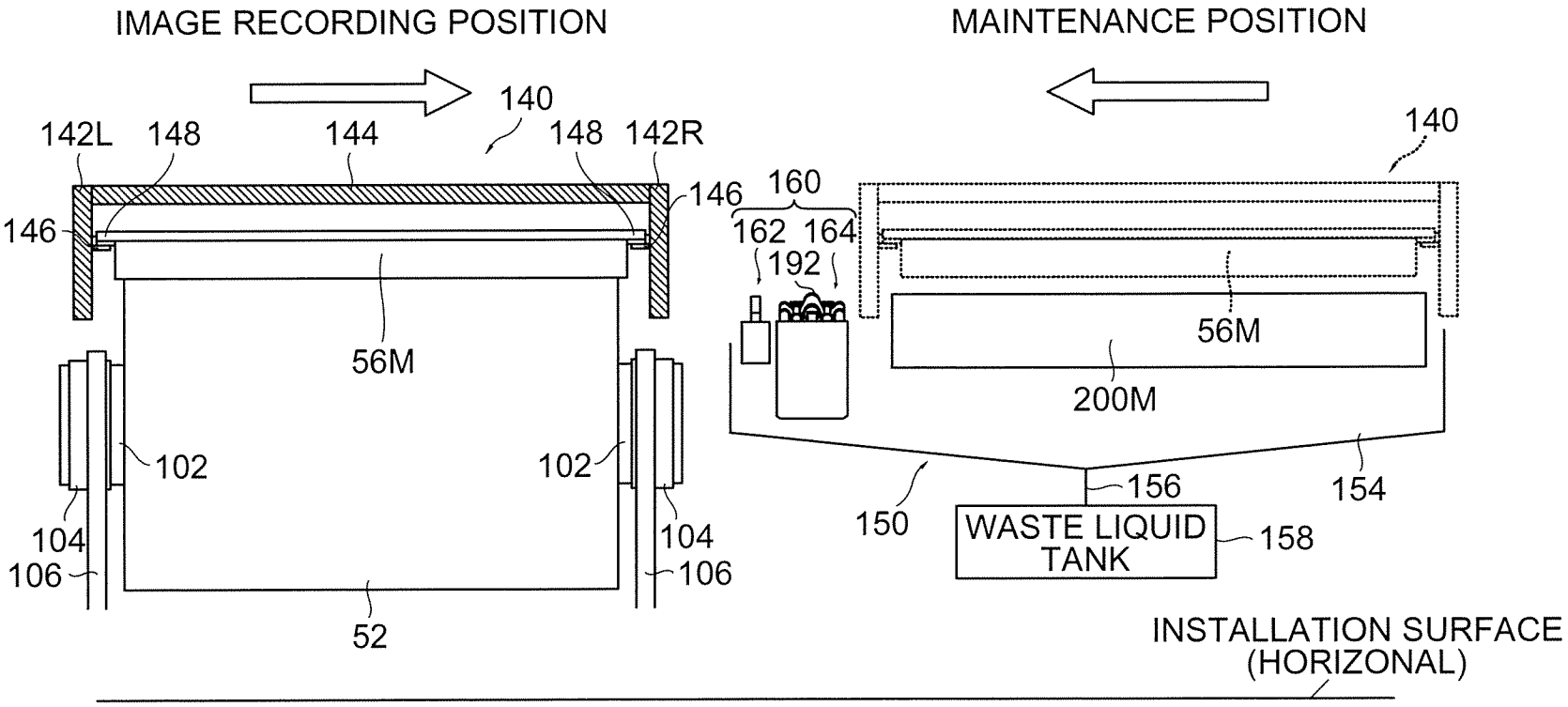
FIG. 5 is a front view of the drawing section and maintenance section (a view seen from an upstream side toward a downstream side in a paper sheet conveying direction)
Figure 6:
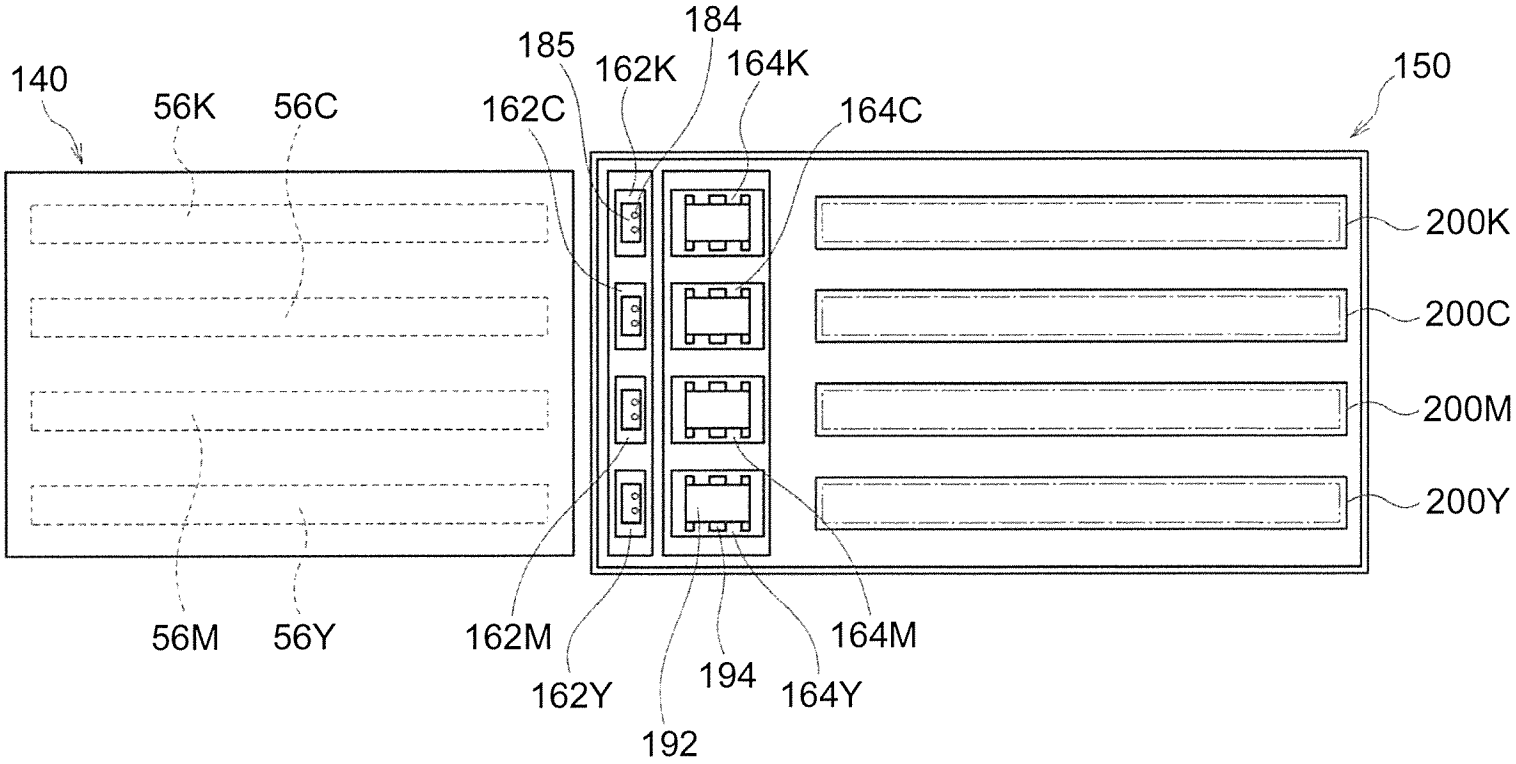
FIG. 6 is a planar development illustration schematically illustrating a configuration of the drawing section and maintenance section.

FIG. 4 is a lateral view illustrating a schematic configuration of the drawing section, and FIG. 5 is a front view thereof (a view seen from an upstream side toward a downstream side in a paper sheet conveying direction). FIG. 6 is a planar development illustration schematically illustrating a configuration of the drawing section and maintenance section.

As illustrated in FIG. 1 and FIG. 4, the heads 56Y, 56M, 56C, and 56K for respective colors are arranged along the circumferential surface of the image recording drum 52, and nozzle surfaces 56AY, 56AM, 56AC, and 56AK of the respective heads each are arranged in an attitude inclined with respect to a horizontal plane such that the nozzle surfaces 56AY, 56AM, 56AC, and 56AK of the respective heads are at a substantially constant distance (throw distance) from a drum circumferential surface.

In other words, the heads 56Y, 56M, 56C, and 56K for respective colors are radially arranged on concentric circles about a rotary shaft 102 of the image recording drum 52 at a certain interval in a circumferential direction. In the example, four heads 56Y, 56M, 56C, and 56K are arranged left-right symmetrically with respect to a center line along a vertical direction of the image recording drum 52. With respect to a vertical line segment passing through the center of the image recording drum 52 (center line), the head 56M of magenta (M) and head 56Y of yellow (Y) are left-right symmetrically arranged as well as the head 56K of black (K) and the head 56C of cyan (C) are left-right symmetrically arranged.

The respective heads 56Y, 56M, 56C, and 56K arranged like this are arranged with their nozzle surfaces 56AY, 56AM, 56AC, and 56AK formed on their lower ends facing the outer circumferential surface of the image recording drum 52, and the respective nozzle surfaces 56AY, 56AM, 56AC, and 56AK each are positioned at a predetermined height from the outer circumferential surface of the image recording drum 52 (gaps of the same amount are defined between the outer circumferential surface of the image recording drum and the nozzle surfaces 56AY, 56AM, 56AC, and 56AK). The nozzle alignment formed on the nozzle surfaces 56AY, 56AM, 56AC, and 56AK is arranged to be perpendicular to the conveying direction of the paper sheet P.

These plural heads 56Y, 56M, 56C, and 56K are mounted on a head supporting frame 140 and arranged around the image recording drum 52.

The image recording drum 52 is rotatably provided with both ends of its rotary shaft 102 being journaled on a pair of bearings 104 (see FIG. 5). The bearings 104 are provided to a main body frame 106 of the inkjet recording apparatus 10, and the image recording drum 52 is horizontally mounted with both ends of the rotary shaft 102 being journaled on the bearings 104 (the rotary shaft 102 is mounted in parallel with a horizontal installation surface).

The rotary shaft 102 of the image recording drum 52 is coupled with a motor via a rotation transmission mechanism not illustrated. The image recording drum 52 is driven by the motor to rotate.

As illustrated in FIG. 5, the head supporting frame 140 includes a pair of side plates 142L and 142R provided to be perpendicular to the rotary shaft 102 of the image recording drum 52, and a coupling frame 144 for coupling with the pair of side plates 142L and 142R at an upper end portion.

The side plates 142L and 142R, which are formed into a plate, are arranged so as to face each other with the image recording drum 52 interposed therebetween. The pair of side plates 142L and 142R have mounting parts 146 provided inside thereof for mounting the respective heads 56Y, 56M, 56C, and 56K. FIG. 5 illustrates only the mounting parts 146 for magenta for the convenience of illustration, but the same mounting parts are provided for each head of each color.

The respective mounting parts 146 are radially arranged on concentric circles about the rotary shaft 102 of the image recording drum 52 at a certain interval. Each of the heads 56Y, 56M, 56C, and 56K is mounted on the head supporting frame 140 with mounted parts 148 formed on both ends thereof being fixed to the mounting parts 146. FIG. 5 illustrates only the mounted parts 148 for magenta for the convenience of illustration, but the same mounting parts are provided for each head of each color.

In this way, the respective heads 56Y, 56M, 56C, and 56K are mounted on the head supporting frame 140 and are radially arranged on concentric circles about the rotary shaft 102 of the image recording drum 52 at a certain interval.

The head supporting frame 140 is provided to be slidably movable in parallel with the rotary shaft 102 of the image recording drum 52 by being guided by a guide rail not illustrated. Then, the frame 140 is driven by a linear drive mechanism not illustrated (e.g., feed screw mechanism or the like) to move between an "image recording position" illustrated by a solid line in FIG. 5 and a "maintenance position" illustrated by a broken line in FIG. 5.

When the head supporting frame 140 is positioned at the image recording position, the respective heads 56Y, 56M, 56C, and 56K are arranged around the image recording drum 52 and ready to record an image.

The maintenance position is set to a position to which the respective heads 56Y, 56M, 56C, and 56K retract from the image recording drum 52. There is provided, at the maintenance position, a wetting device 150 for wetting the respective heads 56Y, 56M, 56C, and 56K.

The wetting device 150 includes caps (head housing part) 200M, 200K, 200C, and 200Y for covering the nozzle surfaces 56AY, 56AM, 56AC, and 56AK of the respective heads 56Y, 56M, 56C, and 56K (see FIG. 6). FIG. 6 illustrates a planar development illustration of a configuration of the heads of the respective colors arranged along an arc of the drum circumferential surface and caps corresponding to the respective heads for easy understanding. Note that FIG. 5 illustrates only the cap 200M for magenta for the convenience of illustration.

In a case where the apparatus is stopped for a long time of period such as the power-off state of the apparatus or the print stand-by period, the heads 56Y, 56M, 56C, and 56K are moved to the maintenance position to cover the nozzle surfaces 56AY, 56AM, 56AC, and 56AK of the respective heads by the caps 200M, 200K, 200C, and 200Y.

The respective caps 200M, 200K, 200C, and 200Y include a wetting liquid supplying mechanism not illustrated and are configured to be capable of being supplied with the wetting liquid in the caps. The caps 200M, 200K, 200C, and 200Y holding the wetting liquid cover surroundings of the nozzle surfaces 56AY, 56AM, 56AC, and 56AK such that nozzles portion is wetted to prevent clogging caused by drying (no-ejection).

Note that the caps 200M, 200K, 200C, and 200Y include a pressurizing and suctioning mechanism not illustrated to be configured to be able to pressurize and suction the inside of the nozzles. In the case of the example, pressure purge may be performed in which an ink supplying system for the respective heads 56Y, 56M, 56C, and 56K is pressurized to forcibly push the inks out of all nozzles of the respective heads 56Y, 56M, 56C, and 56K.

There is arranged a waste liquid tray 154 at a lower location of the caps 200M, 200K, 200C, and 200Y. The wetting liquid supplied to the caps 200M, 200K, 200C, and 200Y or the purge ink is discarded in the waste liquid tray 154 and collected via a waste liquid collecting pipe 156 into a waste liquid tank 158.

There is provided between the image recording position and the maintenance position a nozzle surface cleaning device 160 for cleaning the nozzle surfaces 56AY, 56AM, 56AC, and 56AK of the respective heads 56Y, 56M, 56C, and 56K. When the respective heads 56Y, 56M, 56C, and 56K are in a course of moving from the maintenance position to the image recording position or in a course of moving from the image recording position to the maintenance position, the nozzle surfaces 56AY, 56AM, 56AC, and 56AK are cleaned by the nozzle surface cleaning device 160.

The nozzle surface cleaning device 160 includes a cleaning liquid applying device 162 and a nozzle surface wiping device 164. FIG. 3 illustrates only the nozzle surface cleaning device 160 corresponding to the inkjet head 56M for magenta, but the same nozzle surface cleaning device is provided to each of the heads 56Y, 56M, 56C, and 56K (see FIG. 6).

As illustrated in FIG. 6, the cleaning liquid applying devices 162M, 162K, 162C, and 162Y, and the nozzle surface wiping devices 164M, 164K, 164C, and 164Y are provided correspondingly to the respective heads. Configurations of the cleaning liquid applying devices 162M, 162K, 162C, and 162Y corresponding to the respective heads are the same, and therefore, hereinafter, the description is given for the cleaning liquid applying device 162. Configurations of the nozzle surface wiping devices 164M, 164K, 164C, and 164Y corresponding to the respective heads are also the same, and therefore, hereinafter, the description is given for the nozzle surface wiping device 164.

The cleaning liquid applying device 162, which is a device which applies the cleaning liquid to nozzle surface 56A of the head 56, includes a cleaning liquid supplying nozzle 184 and a cleaning liquid retaining face 185 on which the cleaning liquid is retained. A hole of the cleaning liquid supplying nozzle 184 is opened on the cleaning liquid retaining face 185, and the cleaning liquid is output from the cleaning liquid supplying nozzle 184 to retain cleaning liquid on the cleaning liquid retaining face 185. The cleaning liquid retaining face 185 retaining the cleaning liquid thereon is moved on the head 56 such that the cleaning liquid between the cleaning liquid retaining face 185 and the nozzle surface 56A spreads by use of repellency of the nozzle surface 56A to allow the nozzle surface 56A to be coated with the cleaning liquid.

The nozzle surface wiping device 164 wipes the nozzle surface 56A by moving the head 56 with a wiping web 192 (corresponding to a "wiping member") formed into a belt shape being made to travel in a state where the wiping web 192 abuts on the nozzle surface 56A.

The wiping web 192 is formed of, for example, a sheet made of a microfiber knitted fabric or woven fabric using PET (polyethylene terephthalate), PE (Polyethylene), NY (NYLON) or the like, and is formed into a belt shape having a width corresponding to the width of nozzle surface 56A of the head 56. The wiping web 192 is provided in a state of being wound around a feed side web core not illustrated into a rolled shape with the leading end being fixed to a take-up side web core (not illustrated).

The nozzle surface wiping device 164 includes a conveying section not illustrated for conveying the wiping web 192, and a pressing roll 194 for abutting the wiping web 192 against the nozzle surface 56A at a predetermined pressure. The pressing roll 194 is biased by a biasing spring not illustrated in a direction toward the nozzle surface 56A. The wiping web 192 wound around the pressing roll 194 is conveyed by driving a take-up motor not illustrated. By wiping the nozzle surface 56A while the wiping web 192 is made to travel, a new surface (unused area) of the wiping web 192 can be always used to wipe the nozzle surface 56A.

By moving the nozzle surface 56A in a direction opposite to a travelling direction of the wiping web 192, the nozzle surface 56A can be efficiently wiped.

The nozzle surface wiping device 164 can be moved in an up-and-down direction by a lifting and lowering mechanism not illustrated. In a case where wipe cleaning is not needed for the nozzle surface 56A, the wiping web 192 is retracted to a position where it does not contact the nozzle surface 56A.

The nozzle surface wiping device 164 may include a cleaning liquid applying part for directly applying the cleaning liquid to the wiping web 192 or a cleaning liquid collecting part for collecting the excess cleaning liquid from the wiping web 192.

Although not illustrated in the figure, each of the heads 56Y, 56M, 56C, and 56K is supported by a movable supporting mechanism which is movable in a normal line direction of each of the respective nozzle surfaces 56AY, 56AM, 56AC, and 56AK. This movable supporting mechanism can adjust distances (gaps) between the nozzle surfaces 56AY, 56AM, 56AC, and 56AK of the respective heads 56Y, 56M, 56C, and 56K and the outer circumferential surface of the image recording drum 52, or change a height of the head at the maintenance position.

<Explanation of Maintenance Section Including Wetting Device>

Figure 7:
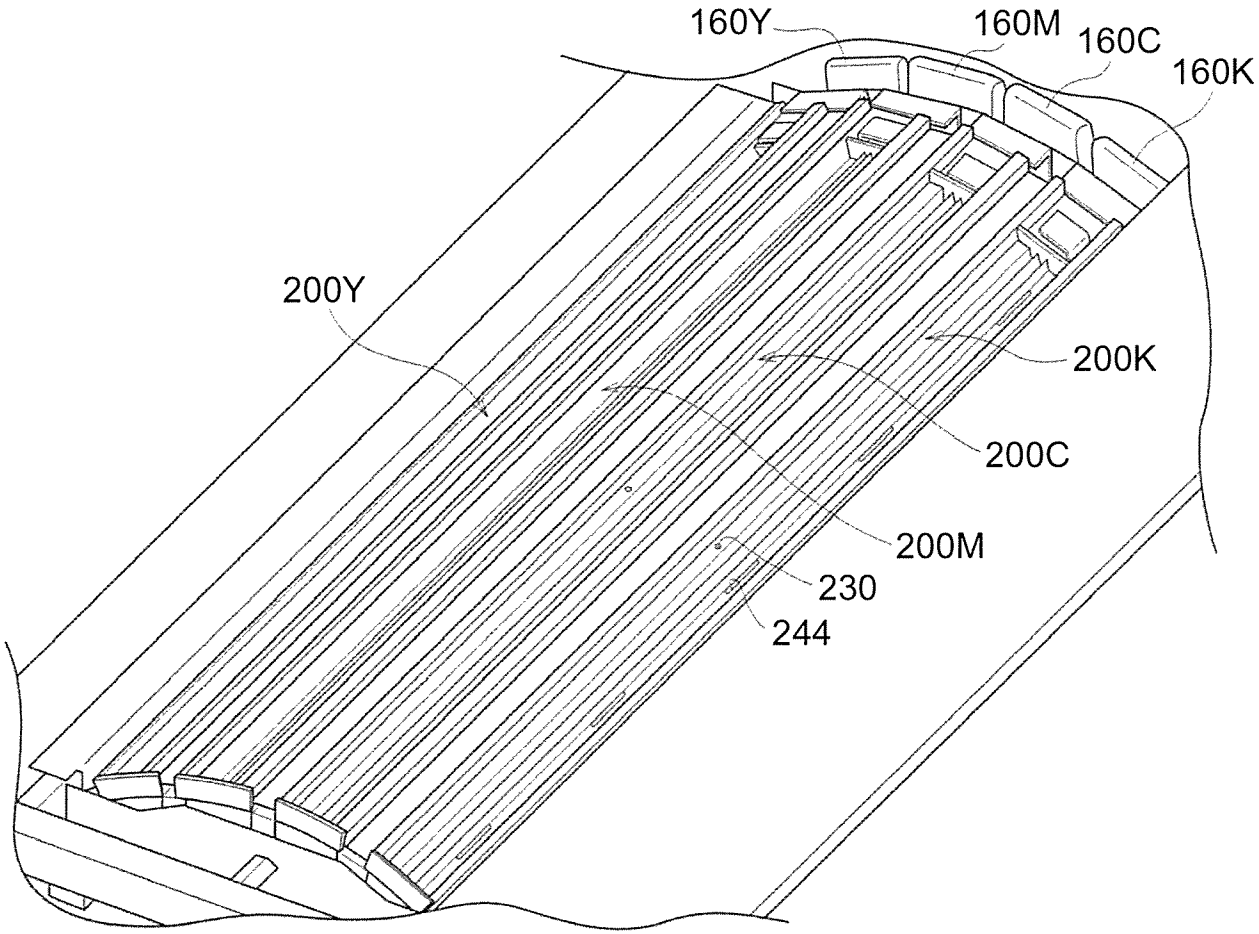
FIG. 7 is a perspective view illustrating a main part of a maintenance station including a wetting device according to the embodiment.
Figure 8:
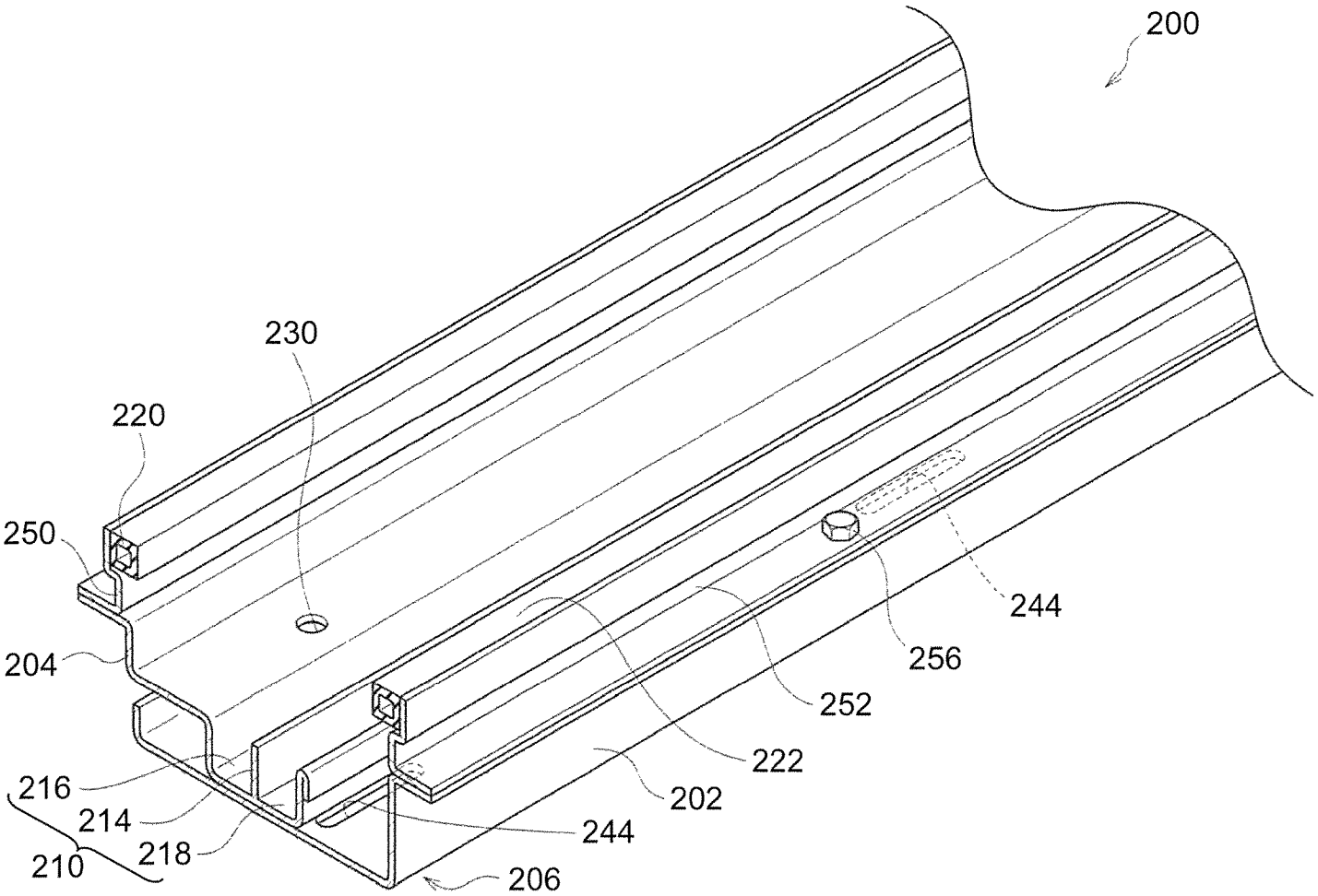
FIG. 8 is a partial enlarged view of a cap.
Figure 9:
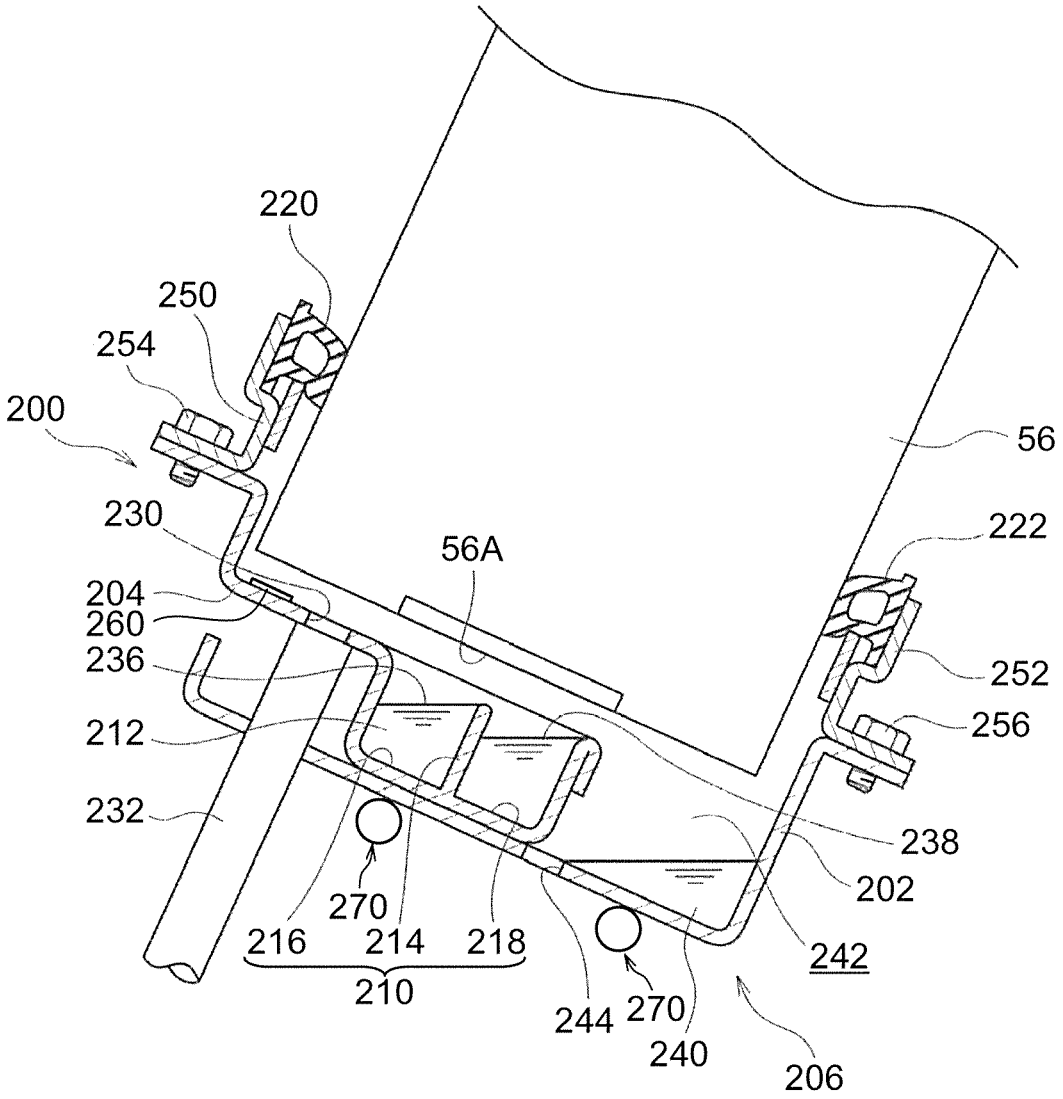
Figure 10:
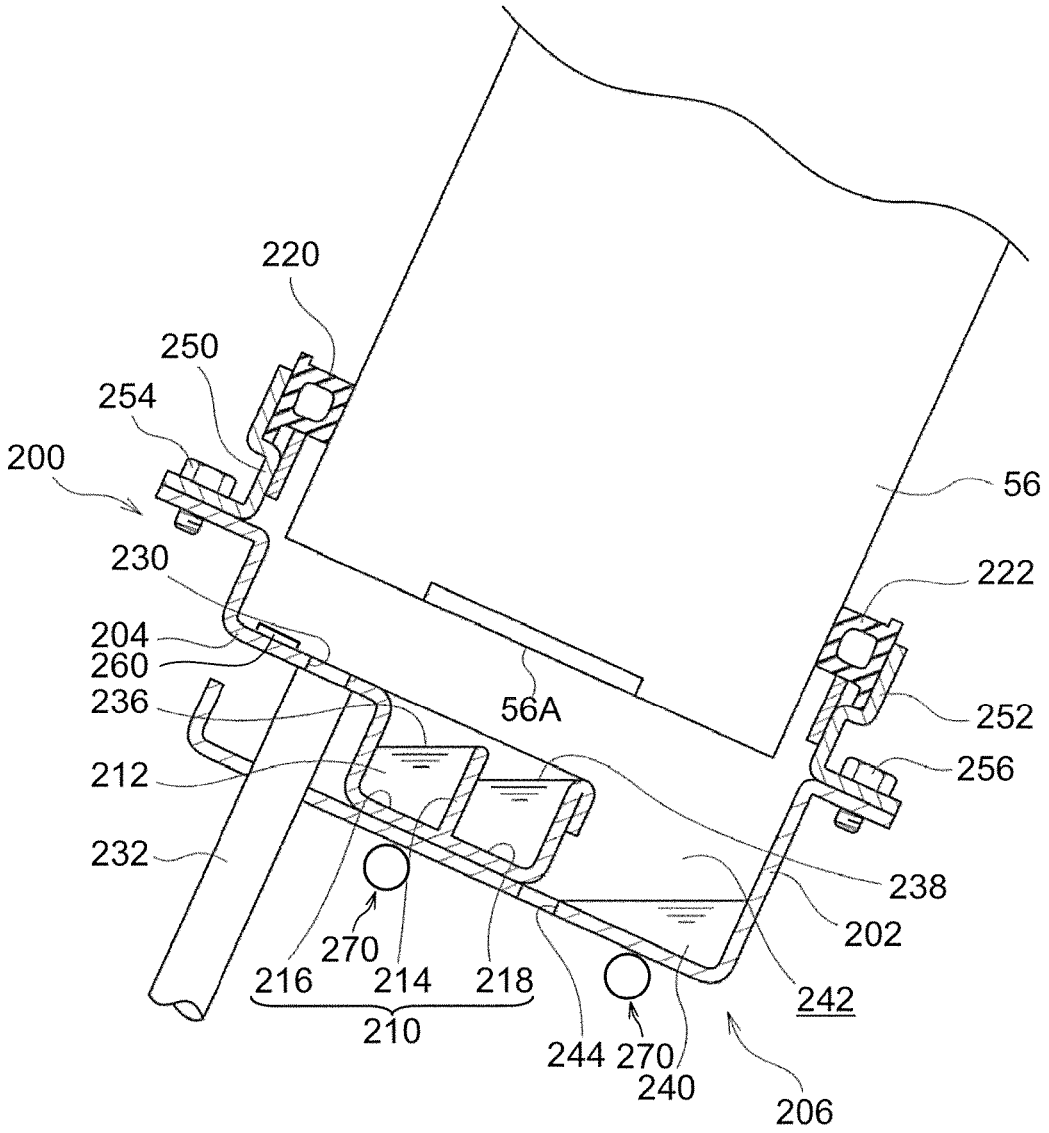
FIG. 10 is a cross-sectional view illustrating a state during an ink purge operation.

FIG. 7 is a perspective view illustrating a main part of a maintenance station including the wetting device according to the embodiment, and FIG. 8 is a partial enlarged view of the cap. FIG. 9 is a cross-sectional view illustrating a state during a capping period (when a head is retained in a wetting state) or during a print stand-by period, in a power-off state or the like, and FIG. 10 is a cross-sectional view illustrating a state during an ink purge operation.

As illustrated in FIG. 7, the maintenance station is provided with the caps 200M, 200K, 200C, and 200Y corresponding to the respective heads. Configuration of the respective caps 200M, 200K, 200C, and 200Y are the same, and therefore, the respective caps are represented by the cap which is designated by reference numeral 200.

The cap 200 includes a cap frame body 202 constituting an outer frame cover part (outer side frame body), and a liquid holding part 210 which is provided inside the cap frame body 202 and arranged at a position facing the nozzle surface 56A. A cap main body 206 is configured in combination of an in-cap frame body 204 (inner side frame body part) which functions as the liquid holding part 210 and has a concave portion formed thereon, and the cap frame body 202 covering the frame body 204. The cap 200 in the example has a double structure (nested structure) like this in which the liquid holding part 210 is provided inside the cap frame body 202.

Sidewalls of the cap 200 (walls on lateral sides along a longitudinal direction of the cap 200 in the example) are provided with sealing members 220 and 222 which elastically deform in abutting on the head 56 to improve sealability. The sealing members 220 and 222 are supported by supporting members 250 and 252, respectively, and the supporting members 250 and 252 supporting the sealing members 220 and 222 are mounted on the cap main body 206 by fixing screws 254 and 256 (corresponding to a "fastening member"), respectively.

In the case of the example, the supporting member 250 is coupled with the in-cap frame body 204 by the fixing screw 254, and the supporting member 252 is coupled with the cap frame body 202 by the fixing screw 256 (see FIG. 9 and FIG. 10). Note that fastened portions by the fixing screws 254 and 256 are arranged at plural portions along the longitudinal direction of the cap 200. The supporting members 250 and 252 are members constitute the sidewalls of the cap 200 together with the in-cap frame body 204 and a sidewall of the cap frame body 202.

The sealing members 220 and 222 provided to the sidewalls of the cap 200 in this way are in contact with sidewalls of the head 56 (walls on lateral sides along a longitudinal direction of the head 56 in the case of the example) to seal contacting portions (see FIG. 9 and FIG. 10). The sealing members 220 and 222 are configured to abut on the sidewalls of the head 56 to seal the head lateral sides at a position higher than the nozzle surface 56A.

The inkjet recording apparatus 10 in the example, which has a mechanism (not illustrated) which moves the cap 200 and the head 56 relatively to each other in the normal line direction of the nozzle surface 56A, can move the head 56 in the normal line direction of the nozzle surface 56A in a state where the sealing members 220 and 222 are brought into contact with head lateral sides as illustrated in FIG. 9 and FIG. 10.

A configuration in which the head 56 is moved relative to the cap 200, a configuration in which the cap 200 is moved relative to the head 56, or a combination of these may be adopted.

Since the head 56 is moved relative to the cap 200 (relative moving) with the sealing members 220 and 222 being in contact with the head lateral side, the sealing members 220 and 222 preferably have a small sliding resistance. In the embodiment, a hollow silicon rubber coated with fluorine is used as the sealing members 220 and 222. Besides the above, brush or felt is suitable for the sealing members 220 and 222. Hairs of brush or fibers of felt elastically deform in abutting and restore an original shape in releasing from abutting. The brush or felt also may function as the sealing member which elastically deforms in abutting to seal the contacting portion.

In both the state of the capping period illustrated in FIG. 9 and the state of the ink purge operation illustrated in FIG. 8, the sealing members 220 and 222 are positioned upper than the nozzle surface 56A and seal the positions higher than the nozzle surface 56A. For this reason, the ink is unlikely to smear on the sealing members 220 and 222.

The sealing members 220 and 222, which are mounted on the cap main body 206 via the fixing screws 254 and 256 as described using FIG. 9 and FIG. 10, can be detached by releasing the coupling of the fixing screws 254 and 256. The sealing members 220 and 222 may be detached and changed integrally with the supporting members 250 and 252, or the sealing members 220 and 222 may be separated from the supporting members 250 and 252 to attach new sealing members 220 and 222 to the supporting members 250 and 252 (only the sealing members 220 and 222 are changed and the supporting members 250 and 252 are used unchanged).

In this way, the sealing members 220 and 222 are configured to be easily detached, which makes is possible to easily change only the sealing members 220 and 222 if the sealing members 220 and 222 are smeared with the ink or the sealability decreases due to time degradation or the like. This can achieve cost reduction and usability improvement.

(Configuration of Liquid Holding Part)

In the cap 200 in the example, the cap 200 is arranged to be inclined with respect to the horizontal plane in conformity to an inclination angle of the nozzle surface 56A which is inclined with respect to the horizontal plane. The liquid holding part 210 arranged at a facing position facing the nozzle surface 56A has a concave portion capable of reserving a wetting liquid 212, and the concave portion has a partition plate 214 (corresponding to "partition member") formed therein in standing manner. The partition plate 214 is extendedly provided in parallel with the longitudinal direction of the cap 200, and partitions the liquid holding part 210 into a first reserving part 216 and a second reserving part 218.

In other words, the liquid holding part 210 is divided into plural areas by the partition plate 214 in an inclination direction of the cap 200, and the first reserving part 216 is formed on an upper side in the inclination direction and the second reserving part 218 is formed on a lower side.

The cap 200 is provided with a wetting liquid supply port 230 for supplying the wetting liquid to the liquid holding part 210. The wetting liquid supply port 230 is arranged on a side upper than the first reserving part 216 in the inclination direction. In the example, one wetting liquid supply port 230 is arranged at a center portion of a cap length in a cap longitudinal direction of the in-cap frame body 204. Note that the number of the wetting liquid supply ports 230 and arranged positions thereof are not limited to those in the example. So long as the liquid holding part 210 can be supplied with the wetting liquid, a configuration to provide plural supply ports of the wetting liquid may be adopted.

The wetting liquid supply port 230 is connected with a wetting liquid flow channel 232, and the wetting liquid is sent from a wetting liquid tank not illustrated through the wetting liquid flow channel 232 to the wetting liquid supply port 230.

The wetting liquid is supplied from the wetting liquid supply port 230 to reserve the wetting liquid 212 in the first reserving part 216 and the second reserving part 218. A liquid level 236 of the wetting liquid reserved in the first reserving part 216 and a liquid level 238 of the wetting liquid reserved in the second reserving part 218 define steps with the partition plate 214 interposed therebetween.

The nozzle surface 56A is inclined with respect to the horizontal plane, but because the liquid holding part 210 facing the nozzle surface 56A has the partition plate 214, the wetting liquid levels (236 and 238) can face the nozzle surface 56A at a closer position.

There is formed, outside the liquid holding part 210, an outer chamber 242 capable of holding a liquid 240 overflown from the liquid holding part 210. The cap frame body 202 has a drain port 244 formed at a bottom thereof, and when a certain amount of the liquid 240 is collected in the outer chamber 242, the liquid is discharged from the drain port 244. The drain port 244 is arranged at a position higher than a lowermost point in the cap inclination direction on the cap bottom, and the outer chamber 242 can collect therein a certain amount of liquid 240.

The cap 200 has provided inside thereof a temperature and humidity sensor 260 for acquiring a relative humidity in a space between the nozzle surface of the head 56 and the cap 200 (nozzle surface vicinity space V). The temperature and humidity sensor 260 is mounted at a position where is above the wetting liquid supply port 230 of the cap 200 and the wetting liquid is not spattered. As the temperature and humidity sensor 260, a digital humidity and temperature sensor SHT1x series from Sensirion Co., Ltd. may be used, for example.

Figure 11:
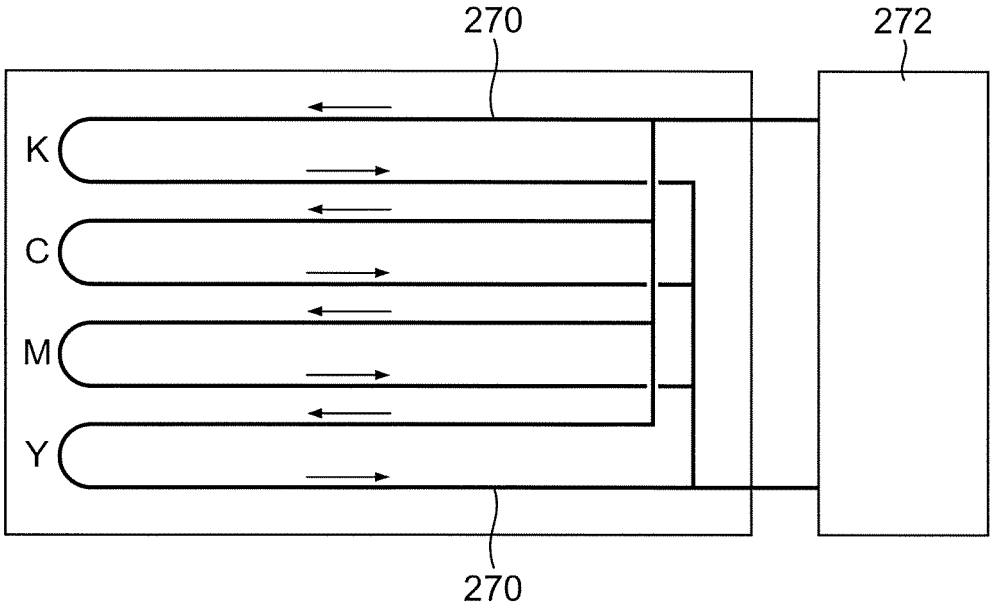
FIG. 11 is a perspective view illustrating a circulating channel of a cooling water.

In the embodiment, a circulating channel 270 is provided on the back face of the cap 200 as illustrated in FIG. 9 to FIG. 11. The circulating channel 270 is provided correspondingly to each of the heads 56Y, 56M, 56C, and 56K. The circulating channel 270 is supplied from a tank 272 with water to be circulated. The tank 272 is provided with a cooling device (chiller, not illustrated) using a chlorofluorocarbon (Freon) refrigerant, for example, in which cooling device a heat is exchanged between the refrigerant and water to circulate the water whose temperature is regulated. By regulating the temperature of the water circulated in the circulating channel 270, a temperature of the nozzle surface vicinity space V of the respective heads 56Y, 56M, 56C, and 56K can be regulated.

Next, a description is given of an operation of supplying the wetting liquid in the embodiment.

<Supply of Wetting Liquid>

A wetting liquid tank (not illustrated) is arranged at a position higher than the wetting liquid supply port 230, and a wetting liquid flow channel 232 is provided for introducing the wetting liquid from the wetting liquid tank to the wetting liquid supply port 230 of the cap 200. A wetting liquid supply valve (not illustrated) capable of supply on (supply)/off (stop) of the wetting liquid is provided in the middle of the wetting liquid flow channel 232 which couples between the wetting liquid tank and the wetting liquid supply port 230. The wetting liquid supply valve is configured of an electromagnetic valve, for example.

When the wetting liquid supply valve is turned on (opened), the wetting liquid flows from the wetting liquid tank through the wetting liquid flow channel 232 due to a water head difference and the wetting liquid flows out of the wetting liquid supply port 230.

The wetting liquid flows down along inclination of the liquid holding part 210 to be collected in the first reserving part 216. A height of the partition plate 214 partitioning between the first reserving part 216 and the second reserving part 218 is lower than other sidewalls of the first reserving part 216 and second reserving part 218. The height of the partition plate 214 referred here is a "height", with reference to an inclined bottom face of the liquid holding part (inclined plane), away from the bottom face toward the nozzle surface 56A in a direction perpendicular to the inclined plane.

For this reason, the wetting liquid overflown from the first reserving part 216 crosses over the partition plate 214, flows down into the second reserving part 218 and is collected in the second reserving part 218.

If the wetting liquid is further continuously supplied and when the second reserving part 218 is filled with the wetting liquid, the wetting liquid crosses over the wall of the second reserving part 218 and falls down into the outer chamber 242.

The drain port 244 of the cap 200 is arranged at a position higher than a lowermost point on a bottom of the outer chamber 242, and thus, the wetting liquid is collected also at the bottom of the outer chamber 242. The outer chamber 242 has a function to make a distance farther between an atmosphere-released portion of the cap 200 and the first reserving part 216 and second reserving part 218 where the liquid levels 236 and 238 of the wetting liquid (hereinafter, referred to as wetting liquid levels 236 and 238) are defined.

The first reserving part 216 and the second reserving part 218 are separated away from the atmosphere-released portion to prevent moisture in the cap from escaping to the outside of the cap.

If the vicinity of the liquid holding part 210 is sealed by the sealing member such as with the outer chamber 242 being omitted, the sealing member is likely to dirty due to purging of the ink or the like. As for this point, according to the embodiment, which is configured such that the outer chamber 242 is provided outside the liquid holding part 210, the sealing members 220 and 222 are mounted on a cap outer wall that is away from the first reserving part 216 and second reserving part 218 where the wetting liquid is collected so as to seal a potion away from the reserving parts, allowing the sealing members 220 and 222 to be prevented from dirty.

In the embodiment, the drain port 244 is arranged at the higher position in the outer chamber 242 so that the liquid is collected also in the outer chamber 242. This allows the outer chamber 242 to be wetted, having an effect of further wetting property improvement.

<Capping Period>

During in a power-off state or during a print stand-by period, or the like, the head 56 stands by at a cap position (head wetting position) illustrated in FIG. 9. As illustrated in FIG. 9, the nozzle surface 56A of the head 56 is placed closer to the wetting liquid levels (236 and 238) of the liquid holding part 210, which increases the relative humidity around the nozzles portion to prevent the ink in the nozzle from solidifying.

<Ink Purging Period>

When purging the ink regularly or irregularly, as illustrated in FIG. 10, the ink is purged in a state where the head 56 and the cap 200 are moved relatively to each other in the normal line direction of the nozzle surface 56A and in a direction separating the head 56 from the cap 200 to make the distance farther between the wetting liquid levels (236 and 238) and the nozzle surface 56A.

A configuration in which the position (height) of the cap 200 is fixed and the head 56 is moved in the normal line direction of the nozzle surface 56A, a configuration in which the position of the head 56 is fixed and the cap 200 is moved, or a configuration in which both of them are moved may be adopted.

As is clear from comparing FIG. 9 to FIG. 10, the distance between the nozzle surface 56A and the wetting liquid levels 236 and 238 during the purging period (in FIG. 10) is farther than the distance between the nozzle surface 56A and the wetting liquid levels 236 and 238 at the head wetting position during the capping period (FIG. 9). This can prevent the purged ink from being collected in a gap between the nozzle surface 56A and the liquid holding part 210 or prevent the wetting liquid in the cap 200 from joining the purged ink.

Further, in the embodiment, the sealing members 220 and 222 are arranged higher than the position of the nozzle surface 56A during the purging period. In other words, as illustrated in FIG. 9, the sealing members 220 and 222 are arranged at a position higher than at least a lowermost position on a lower side of the inclination of the nozzle surface 56A. For this reason, the ink is unlikely to smear on the sealing members 220 and 222.

During the purging period in FIG. 10, the sealing members 220 and 222 seal a position higher than the nozzle surface 56A, and also during the capping period in FIG. 7, the sealing members 220 and 222 seal a position higher than the nozzle surface 56A. In other words, in the case of the example, in both states in FIG. 9 and FIG. 10, the sealing members 220 and 222 are on the upper side of the nozzle surface 56A with the cap being attached.

After purging in the state in FIG. 10, the nozzle surface 56A is wiped to be cleaned (wiping) by the wiping web 192. Note that as the wiping member, a blade may be used in place of or in combination of the wiping web 192.

In the embodiment, the position of the wiping web 192 (that is, a position of the nozzle surface cleaning device 160) is set so that the nozzle surface 56A abuts on the wiping web 192 ("wiping member") when the head 56 is horizontally moved in the longitudinal direction (vertical direction with respect to a paper plane in FIG. 8) with the height of the nozzle surface 56A being kept at a position of purging.

This allows the nozzle surface 56A to be wiped by horizontal moving of the head 56 although the head nozzle surface is smeared with the ink immediately after purging. This removes a foreign matter such as the smeared ink or the like from the nozzle surface 56A and can prevent the ink from spattering to the sealing members 220 and 222.

The embodiment illustrates a configuration in which the sidewall in the cap 200 faced in a head horizontal moving direction (sidewall along the short-side direction) is made to be lower, so that the above horizontal moving operation (parallel moving in a plane the same as the nozzle surface 56A) can be enabled with the height of the nozzle surface 56A during the purging period being kept.

In other words, the cap sidewalls arranged on both ends in the longitudinal direction of the cap 200 (sidewalls constituting wall surfaces of the short side portions) are lower than heights of the cap sidewalls of the long side portions along the longitudinal direction. Note that the lower wall portions are not provided with the sealing member, and an opening is defined as a gap between the nozzle surface 56A and the cap wall. Although the opening decreases the sealability of the cap 200, as described later, a head protecting member for protecting the head 56 (dummy plate, designated by reference numeral and character 56D in FIG. 10) is provided on both ends in the longitudinal direction of the head 56, and the head protecting member 56D has a plane portion which is the same plane as the nozzle surface 56A (which means substantially the same plane including a range accepting an error to an extent regarded as substantially being the same plane).

For this reason, the head protecting member is put between the opening defined between the cap wall made lower than the height of the nozzle surface 56A and the head 56, and a portion of nozzle surface 56A on which the nozzles of the head 56 are actually formed (nozzles portion), giving a enough distance of a size of the head protecting member. Therefore, the sealability decrease due to the opening defined between the wall made lower and the head little affects the wetting property of the nozzles portion.

Note that in the example, the heights of the wall surfaces on both ends in the longitudinal direction of the cap 200 are low, which causes that a completely sealed space cannot be formed, and therefore, the pressure purge is preferable in place of purging by the nozzle sucking.

[Range of Relative Humidity]

Next, a description is given of a range of the relative humidity in the embodiment. First, a relative humidity condition in order to prevent deterioration caused by the dew condensation (upper limit $H_{UL}$) is described with reference to FIG. 12.

Figure 12:
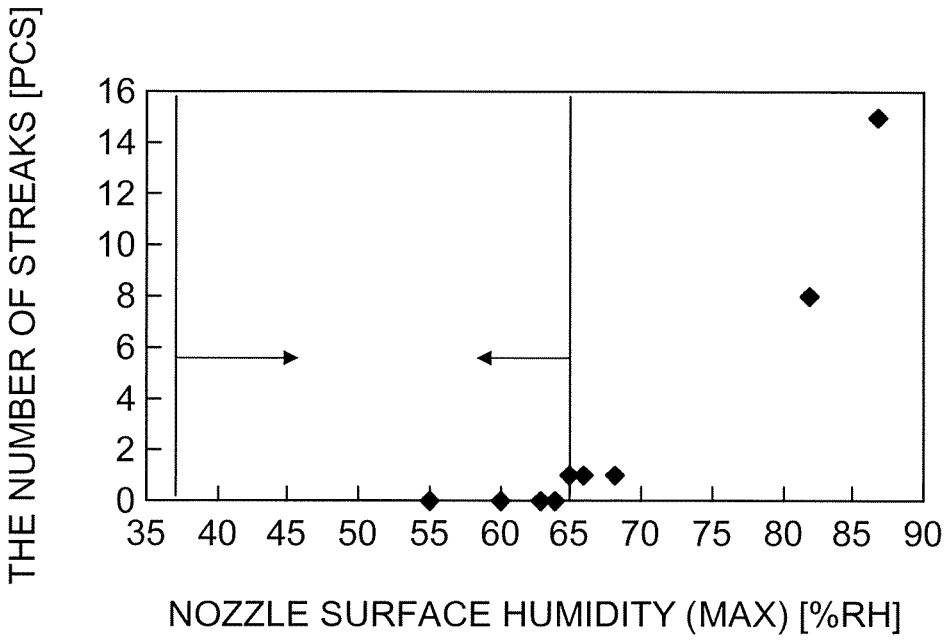
FIG. 12 is a graph illustrating a number of streaks in a case where the ink is ejected after the inkjet head is housed and retained in the cap.

FIG. 12 is a graph illustrating the number of streaks in a case where the ink is ejected after the inkjet head is housed and retained in the cap. In FIG. 12, an ordinate represents the number of streaks (total of KCM inkjet heads), and an abscissa represents a relative humidity (% RH) in a space between the nozzle surface of the inkjet head and the cap (nozzle surface vicinity space V) in housing the inkjet heads. Here, the relative humidity refers to ratio of a water vapor pressure of an actual air to a saturation water vapor pressure at a certain temperature.

From a measurement result illustrated in FIG. 12, it was found that in a case where the relative humidity of the nozzle surface vicinity space V in housing the inkjet head is equal to or more than 65% RH, the dew condensation occurs on the nozzle surface to deteriorate the ejection performance.

Therefore, by setting a relative humidity H in the nozzle surface vicinity space V in retaining the inkjet head as $H_{UL}$=65% RH or less, the ejection defection caused by the dew condensation can be prevented.

Figure 13:
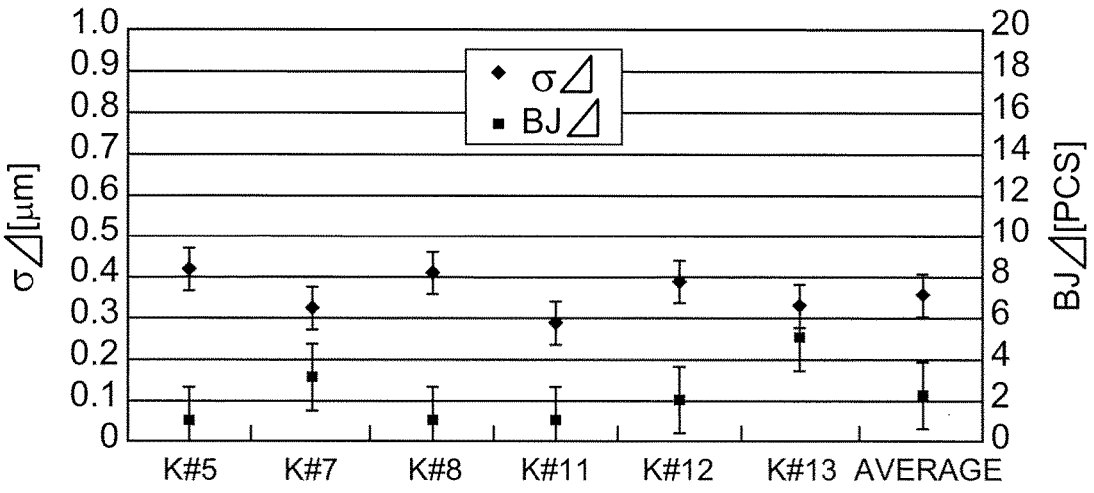
FIG. 13 a graph illustrating variation of an ejection state before and after retaining the inkjet head.
Figure 14:
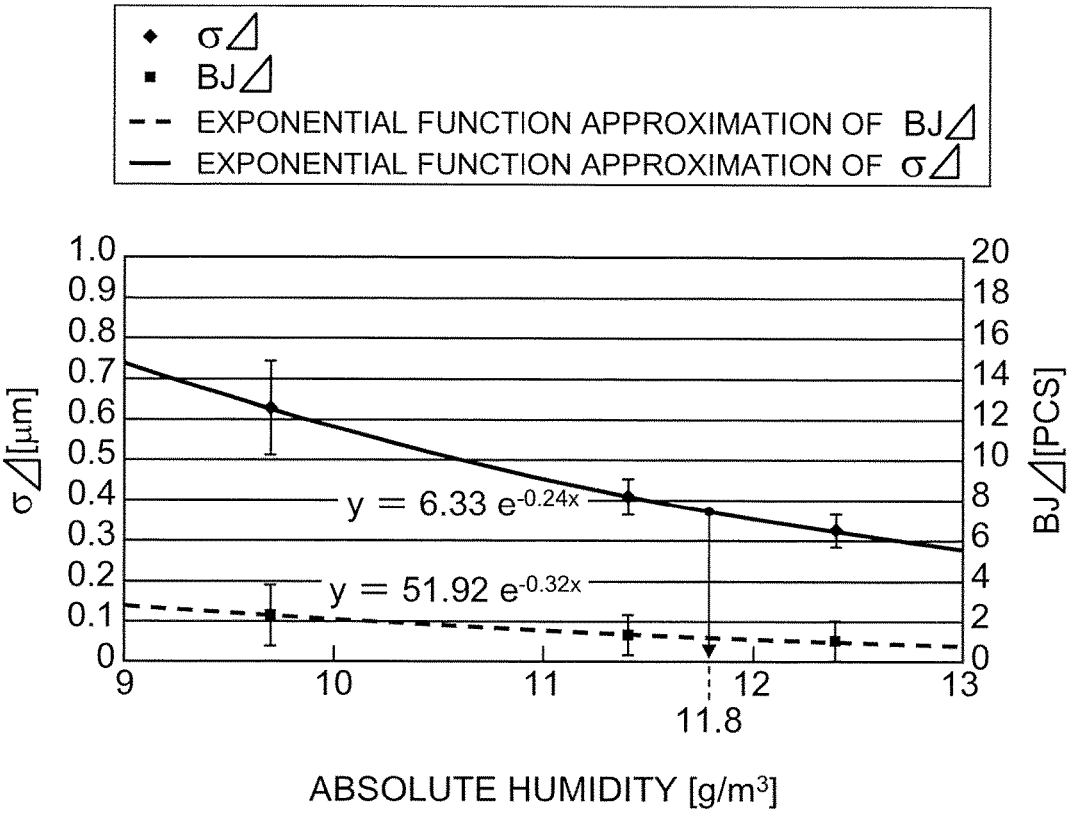
FIG. 14 is a graph illustrating variation of the ejection state in a case where the inkjet head is retained without being housed in the cap.

Next, with reference to FIG. 13 and FIG. 14, a description is given of a relative humidity condition (lower f $H_{LL}$) in order to prevent deterioration caused by drying.

FIG. 13 is a graph illustrating variation of an ejection state before and after retaining the inkjet head. In an example illustrated in FIG. 13, assuming that while the inkjet head was retained in the cap, the ink temperature was kept at 30° C. to be circulated, and the nozzle surface was enough wetted at 95% RH or more at an ambient temperature). Assume that a retaining time period of the inkjet head is four hours.

In FIG. 13, an abscissa represents a module number of the inkjet head, and K#5 represents the fifth module of the black head 56K, for example. An ordinate represents parameters σΔ and BJΔ illustrated below. Note that the parameter σΔ represents a standard deviation of Δ(m) (m=1, . . . , 2048) and represents the number of the nozzles in a case where an absolute value of the parameter BJΔ=Δ(m) is 5 μm or more (m=1, . . . , 2048). Here, m is a nozzle number. Δ(m) represents a difference between landing positions at a nozzle m before and after retaining, and Δ(m)=landing position (m, after retaining)−landing position (m, before retaining) holds. A size of an error bar in FIG. 13 is equal to a standard deviation found from six modules K#5 to K#13 for σΔ and BJΔ.

Note that the reason why the number of nozzles of |Δ(m)|≥5 μm was counted for BJΔ is because a case where the landing position is deviated by 5 μm or more before and after retaining was set as a threshold for determining the ejection defection with a margin of 2 μm on the basis that the streak is visible if it is about 7 μm or more.

In the embodiment, a case where the respective parameters σΔ (μm) and BJΔ (the number) are out of a range of averages of them ±(1×standard deviation) (see Table 2) is regarded as the ejection defection (degraded).

TABLE 2

| | AVERAGE | STANDARD DEVIATION | AVERAGE − 1 × STANDARD DEVIATION | AVERAGE + 1 × STANDARD DEVIATION |
|---|---|---|---|---|
| σΔ (μm) | 0.36 | 0.05 | 0.31 | 0.41 |
| BJΔ (NO. OF PCS) | 2.2 | 1.6 | 0.6 | 3.8 |

FIG. 14 is a graph illustrating variation of the ejection state in a case where the inkjet head is retained without being housed in the cap. FIG. 14 illustrates the parameters σΔ and BJΔ when an absolute humidity in retaining the inkjet head for 8 hours is 9.7 g/m$^3$ (27° C. 39% RH), 11.4 g/m$^3$ (28° C. 42% RH), and 12.4 g/m$^3$ (29° C. 43% RH). Here, an experiment was performed using the absolute humidity as a reference in consideration that the absolute humidity in the cap has largely effects on water evaporation from nozzle holes. Note that a size of an error bar in FIG. 14 is equal to a standard deviation found from six modules K#5 to K#13 for σΔ and BJΔ.

From a result illustrated in FIG. 14, it was found that the parameter σΔ is higher in sensitivity than BJΔ with respect to an absolute humidity variation, that is, the parameter σΔ is larger in an amount of change than BJΔ with respect to the absolute humidity variation. This may be considered to mean that if the absolute humidity decreases, landing position displacement of 5 μm or less (small bending) firstly occurs, and the landing position displacement gradually increases.

In FIG. 14, if a relationship between the absolute humidity x (g/m$^3$) and σΔ is exponentially approximated, an approximation formula 1 below is obtained.

$$\sigma\Delta\ (\mu m)=6.33\ \exp(-0.24x) \qquad \text{(approximation formula 1)}$$

Then, a determination threshold for the ejection defection (degraded) of σΔ from Table 2 is 0.41 μm, and the absolute humidity is 11.8 g/m$^3$ when σΔ becomes a value (0.37 μm) which is obtained by subtracting a width of the error bar 0.04 μm in the vicinity of the determination threshold from the determination threshold. From this, it can be derived that the determination threshold of the absolute humidity is 11.8 g/m$^3$ (37% RH in relative humidity terms) when the ejection defection (degraded) occurs in a case where a temperature of the nozzle surface is 30° C.

As for the ejection defection caused by the dew condensation occurring when the relative humidity is high ($H>H_{UL}$), it can be considered to recover the ejection performance by maintaining such as wiping the nozzle surface using the web. However, the ejection defection caused by drying when the relative humidity is low ($H<H_{LL}$), the ejection performance may not be probably recovered only by the normal maintenance such as the wiping or purging process.

Therefore, in the embodiment, by keeping the relative humidity H in the nozzle surface vicinity space V in housing the inkjet head in a range of $H_{LL}\leq H\leq H_{UL}$ ($H_{LL}$=37% RH and $H_{UL}$=65% RH), the ejection performance is prevented from deteriorating.

[Control of Inkjet Recording Apparatus]

Figure 15:
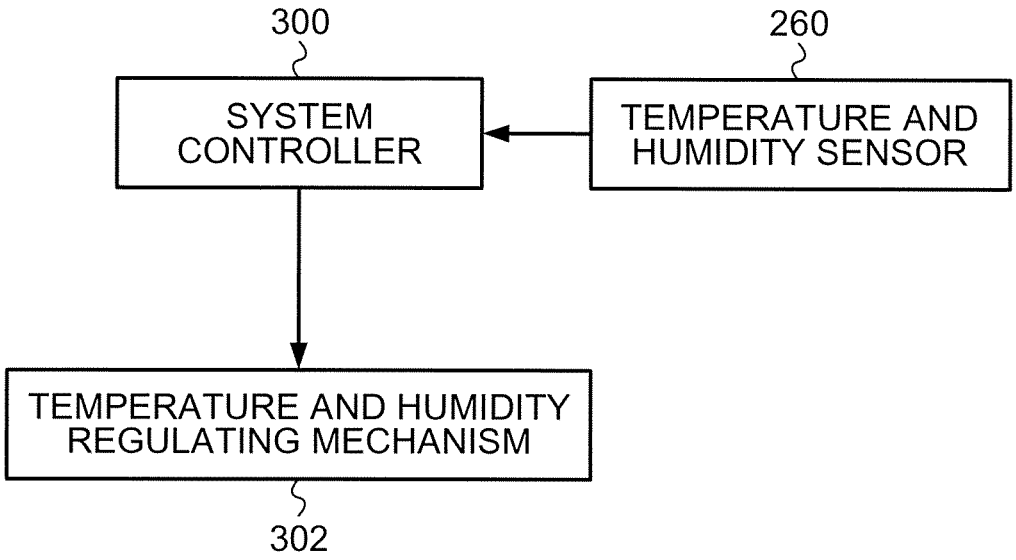
FIG. 15 is a block diagram illustrating a control system for temperature and humidity in the inkjet recording apparatus according to an embodiment of the presently disclosed subject matter.

FIG. 15 is a block diagram illustrating a control system for temperature and humidity in the inkjet recording apparatus according to an embodiment of the presently disclosed subject matter.

As illustrated in FIG. 15, the control system for temperature and humidity in the inkjet recording apparatus 10 includes a system controller 300 and a temperature and humidity regulating mechanism 302.

The system controller 300 functions as a controlling device which collectively controls the sections and units in the inkjet recording apparatus 10 and functions as a calculation device which performs various calculation processes. The system controller 300 includes a CPU (Central Processing Unit), a ROM (Read Only Memory) in which stored are a control program executed by the system controller 300 and various pieces of data required for controlling, and a RAM (Random Access Memory) used as a work area or an area for temporarily holding data. The system controller (humidity acquiring part) 300 calculates the relative humidity H of the nozzle surface on the basis of the measurement result of the temperature and humidity of the nozzle surface vicinity space V input from the temperature and humidity sensor 260, and controls the temperature and humidity regulating mechanism 302 to perform a humidification process and a dehumidification process to keep the relative humidity H of the nozzle surface in a range of $H_{LL} \leq H \leq H_{UL}$ ($H_{LL}$=37% RH and $H_{UL}$=65% RH). Note that in addition to or in place of the relative humidity of the nozzle surface, the relative humidity of the nozzle surface vicinity space V including the nozzle surface may be calculated and controlled.

The temperature and humidity regulating mechanism 302 (temperature and humidity regulating part) regulates the temperature and humidity of the nozzle surface (or the nozzle surface vicinity space V) in accordance with the control by the system controller 300. The temperature and humidity regulating mechanism 302 regulates the relative humidity by switching between supply and supply-stop of the cooling water to the circulating channel 270, adjusting the distance between the head 56 and the cap 200, supplying or reducing the wetting liquid, blowing by use of a fan (not illustrated) provided to the housing 310, and the like.

As a method for increasing the relative humidity of the nozzle surface, there may be considered methods (A1) the supply of the cooling water to the circulating channel 270 is stopped to increase a temperature of the wetting liquid in the cap 200, (A2) the distance between the head 56 and the cap 200 is shortened (including transition from a state of the cap 200 being detached to a state of being housed in the cap 200), (A3) the wetting liquid is added, and a combination of at least two of (A1) to (A3).

As a method for decreasing the relative humidity of the nozzle surface, there may be considered methods (B1) the cooling water is supplied to the circulating channel 270 to decrease a temperature of the wetting liquid in the cap 200, (B2) the distance between the head 56 and the cap 200 is lengthened (including transition from a state of being housed in the cap 200 to a state of the cap 200 being detached), (B3) the wetting liquid is reduced, (B4) a dried air is blown to the nozzle surface, and a combination of at least two of (B1) to (B4).

Figure 16:
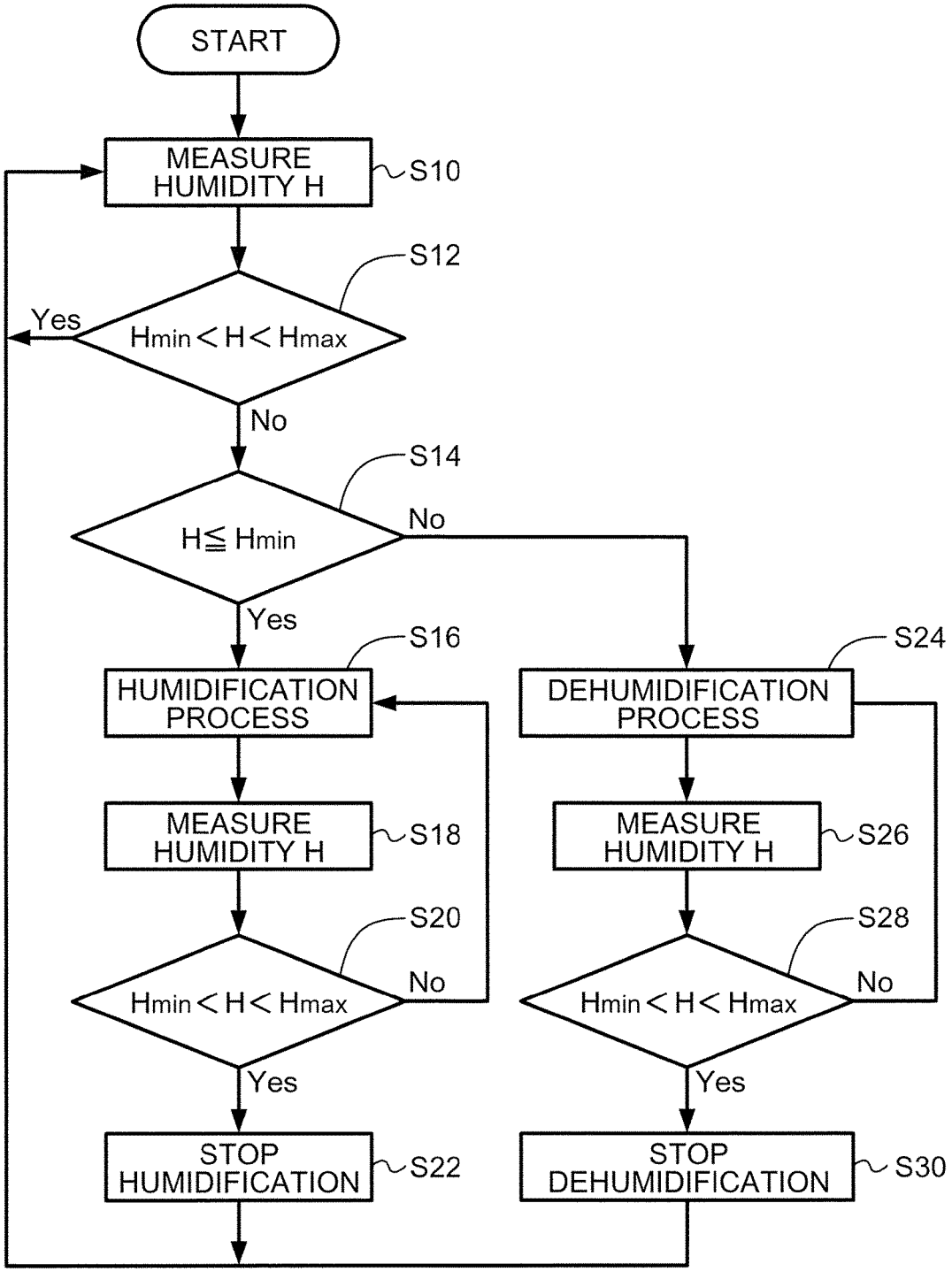
FIG. 16 is a flowchart of a control method for the inkjet recording apparatus according to an embodiment of the presently disclosed subject matter.

FIG. 16 is a flowchart of a control method for the inkjet recording apparatus according to an embodiment of the presently disclosed subject matter. A process illustrated in FIG. 16 is performed continuously while the inkjet head 56 is housed in the cap 200 (head housing step).

First, the temperature and humidity sensor 260 measures the temperature and humidity of the nozzle surface vicinity space V to calculate the relative humidity H of the nozzle surface (humidity acquiring step: step S10). Next, whether or not the relative humidity H satisfies $H_{min}<H<H_{max}$ (step S12). Here, $H_{min}$ and $H_{max}$ (which respectively correspond to a first threshold and a second threshold) are respectively values containing a margin (5% RH) for $H_{LL}$ (=37% RH) and $H_{UL}$ (=65% RH), that is, $H_{min}$=37% RH+5% RH=42% RH and $H_{max}$=65% RH−5% RH=60% RH. The margin allowed like this makes it possible to ensure that the relative humidity H of the nozzle surface falls within a range of $H_{LL} \leq H \leq H_{UL}$. Note that an aspect not allowing a margin may be possible.

If the relative humidity H of the nozzle surface satisfies $H_{min}<H<H_{max}$ (Yes at step S12), the process returns to step S10 to continue to monitor the relative humidity H of the nozzle surface.

On the other, if the relative humidity H of the nozzle surface does not satisfy $H_{min}<H<H_{max}$ (No at step S12), whether or not the relative humidity H of the nozzle surface is equal to or less than $H_{min}$ (step S14). If the state of the relative humidity H of the nozzle surface being equal to or less than $H_{min}$ ($H \leq H_{min}$) continues, the humidity may probably further decrease to dry the ink remaining on the nozzle surface. For this reason, the humidification process (see from (A1) to (A3)) is started on the nozzle surface vicinity space V (temperature and humidity regulating step: step S16) to measure the relative humidity H of the nozzle surface during performing the humidification process (step S18). The humidification process is continued until the relative humidity H of the nozzle surface falls within the range of $H_{min}<H<H_{max}$ (loop from step S16 to S20). Then, when the relative humidity H of the nozzle surface falls within the range of $H_{min}<H<H_{max}$ (Yes at step S20), the humidification process is stopped (step S22), the process returns to step S10 to continue to monitor the relative humidity H of the nozzle surface.

Next, in the case where the relative humidity H of the nozzle surface does not satisfy $H_{min}<H<H_{max}$ (No at step S12) and in the case where the relative humidity H of the nozzle surface is not $H_{min}$ equal to or less than (No at step S14), a case is reached where the relative humidity H of the nozzle surface is equal to or more than $H_{max}$ ($H \geq H_{max}$). If the state of the relative humidity H of the nozzle surface is equal to or more than $H_{max}$ ($H \geq H_{max}$) continues, the humidity may probably further increase to generate the dew condensation on the nozzle surface. For this reason, the dehumidification process (see from (B1) to (B4)) is started on the nozzle surface vicinity space V (temperature and humidity regulating step: step S24) to measure the relative humidity H of the nozzle surface during performing the dehumidification process (step S26). The dehumidification process is continued until the relative humidity H of the nozzle surface falls within the range of $H_{min}<H<H_{max}$ (loop from step S24 to S28). Then, when the relative humidity H of the nozzle surface falls within the range of $H_{min}<H<H_{max}$ (Yes at step S28), the dehumidification process is stopped (step S30), the process returns to step S10 to continue to monitor the relative humidity H of the nozzle surface.

According to the embodiment, by keeping the relative humidity of the nozzle surface in the range of $H_{min}<H<H_{max}$, both the ejection defection caused by drying of the nozzle surface and the ejection defection caused by the dew condensation can be prevented from occurring.

In the embodiment, if the relative humidity H of the nozzle surface becomes less than $H_{min}$ or larger than $H_{max}$, it is preferable to perform a maintenance process (a recovering process, for example, a wiping process or purging of the nozzle surface) before the next printing is carried out. Such a process can reduce the waste sheet.

A timing of stopping the humidification process or the dehumidification process may be changed depending on variability of the relative humidity (e.g., seasons). In a dry-prone season (e.g., dry season or wintertime), the threshold $H_{max}$ in stopping the dehumidification process may be set to be higher as compared to other seasons. In a humid season (e.g., a rainy season or so-called Baiu season), the threshold $H_{min}$ in stopping the humidification process may be set to be lower as compared to other seasons.

The humidification process and the dehumidification process may be continued until the relative humidity H of the nozzle surface becomes a value enough larger than $H_{min}$ and enough smaller than $H_{max}$. Here, the case where the relative humidity H of the nozzle surface becomes a value enough larger than $H_{min}$ and enough smaller than $H_{max}$ refers to a case, for example, where the following formulas (1) and (2) are satisfied. By doing so, a time until the next humidification process or dehumidification process is required can be elongated, reducing the number of the humidification processes and dehumidification processes to be performed.

$$H \approx (H_{max}+H_{min})/2 \quad (1)$$

$$(H_{max}+H_{min})/2-(H_{max}-H_{min})\times\alpha_1\leq H\leq(H_{max}+H_{min})/2+(H_{max}-H_{min})\times\alpha_2 \quad (2)$$

Note that $\alpha_1$, $\alpha_2$=10% to 25%, in one example.

Values of $\alpha_1$ and $\alpha_2$ in the formula (2) may be variable depending on variability of the relative humidity (e.g., seasons). For example, in a dry-prone season (e.g., dry season or wintertime), $\alpha_1$ and $\alpha_2$ may be set in accordance with at least one of "$\alpha_1$ is set to be smaller (including a case of a negative value) as compared to other seasons", "$\alpha_2$ is set to be larger as compared to other seasons", and "$\alpha_1<\alpha_2$ is to hold". In a humid season (e.g., a rainy season or so-called Baiu season), $\alpha_2$ and $\alpha_1$ may be set in accordance with at least one of "$\alpha_1$ is set to be smaller (including a case of a negative value) as compared to other seasons", "$\alpha_1$ is set to be larger as compared to other seasons", and "$\alpha_1>\alpha_2$ is to hold".

[Other Embodiments for Detection of Relative Humidity]

In the above embodiment, the cap 200 is provided with the temperature and humidity sensor 260 to measure the relative humidity, but the embodiment is not limited thereto.

Figure 17:
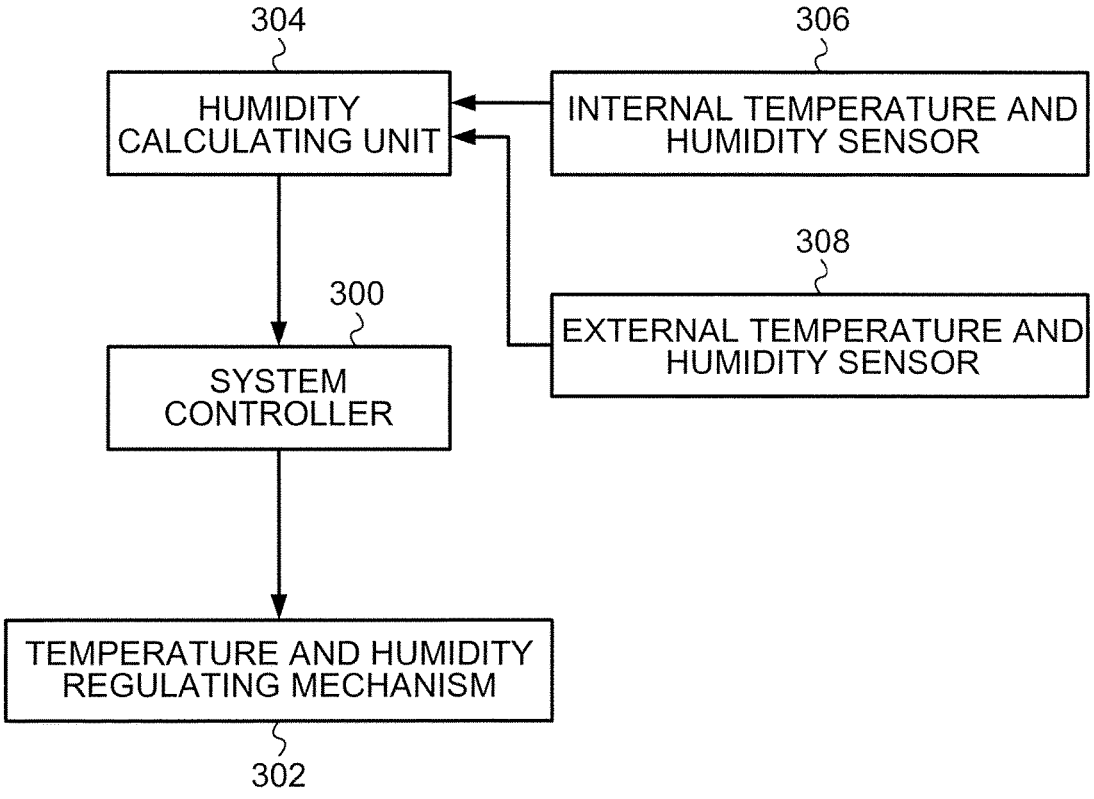
FIG. 17 is a block diagram illustrating an example in which temperature and humidity sensor s are provided respectively to an inside and outside of the inkjet recording apparatus.

FIG. 17 is a block diagram illustrating an example in which temperature and humidity sensor s are provided respectively to an inside and outside of the inkjet recording apparatus.

In an example illustrated in FIG. 17, the control system for temperature and humidity in the inkjet recording apparatus 10 includes, in addition to the system controller 300 and the temperature and humidity regulating mechanism 302, a humidity calculating unit 304, an internal temperature and humidity sensor 306, and an external temperature and humidity sensor.

The internal temperature and humidity sensor 306 outputs a measurement result of the relative humidity inside the inkjet recording apparatus 10 (e.g., in the vicinity of the surface of the image recording drum 52, or in the vicinity of a reading surface of the inline sensor 58) to the humidity calculating unit 304.

The external temperature and humidity sensor 308 outputs a measurement result of the relative humidity outside the inkjet recording apparatus 10 (e.g., a work room where the inkjet recording apparatus 10 is located) to the humidity calculating unit 304.

The humidity calculating unit 304 stores therein in advance data indicating a correspondence relationship of information concerning an external environment of the inkjet recording apparatus 10 (the installation position of the external temperature and humidity sensor 308), an internal environment (the installation position of the internal temperature and humidity sensor 306), and an environment in the cap when the inkjet head 56 is housed in the cap 200 (temperature and humidity) (hereinafter, referred to as temperature and humidity data), and calculates the relative humidity of the nozzle surface in the cap 200 on the basis of relative humidity values input from the internal temperature and humidity sensor 306 and the external temperature and humidity sensor 308, and a table of this correspondence.

The system controller 300 performs the process illustrated in FIG. 16 so that a calculation result of the relative humidity of the nozzle surface calculated by the humidity calculating unit 304 falls within the range of $H_{min}<H<H_{max}$ to control the temperature and humidity regulating mechanism 302.

Figure 18:
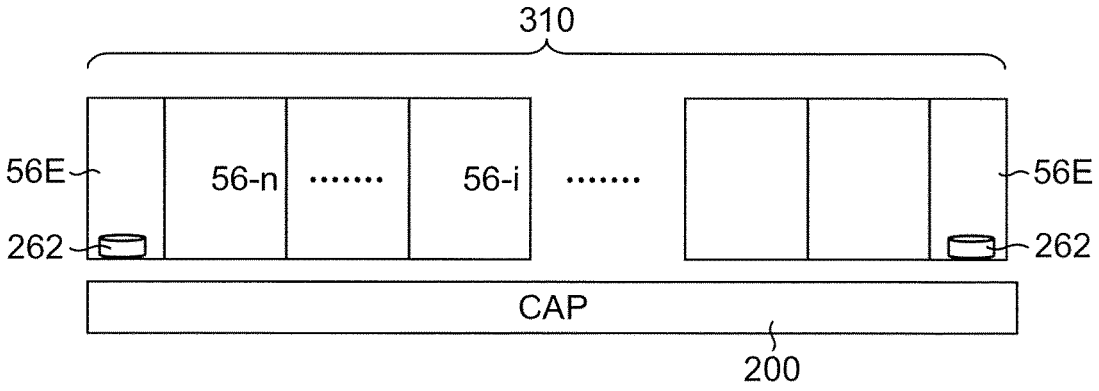
FIG. 18 is a diagram illustrating an example in which a temperature and humidity sensor is provided to the inkjet head.

FIG. 18 is a diagram illustrating an example in which a temperature and humidity sensor is provided to the inkjet head.

As illustrated in FIG. 18, similarly to the above embodiment, the head module 56-*i* in the housing 310 (fixture unit) is fixed, and end caps 56E are respectively fixed on both ends of the head module 56-*i*. In an example illustrated in FIG. 18, the temperature and humidity sensor 262 is fixed inside the end cap 56E. The temperature and humidity sensor 262 can measures a temperature and humidity in the vicinity of the end cap 56E.

The system controller 300 calculates the relative humidity H of the nozzle surface from the measurement result of the temperature and humidity in the vicinity of the end cap 56E. Then, the system controller 300 performs the process illustrated in FIG. 16 so that a calculation result of the relative humidity of the nozzle surface falls within the range of $H_{min}<H<H_{max}$ to control the temperature and humidity regulating mechanism 302.

In the examples in FIG. 17 and FIG. 18 also, the process in FIG. 16 can be applied to control the relative humidity H of the nozzle surface so that it falls within a range of $H_{min}<H<H_{max}$.

Note that, in the examples in FIG. 17 and FIG. 18 also, as the temperature and humidity sensor, a digital humidity and temperature sensor SHT1x series from Sensirion Co., Ltd. may be used.

Note that the aqueous pigment ink is used in the above embodiment, but the presently disclosed subject matter is not limited thereto and an ink other than the aqueous pigment ink can be used.

What is claimed is:

1. An inkjet recording apparatus comprising:

an inkjet head having a nozzle surface on which nozzles configured to eject an ink are formed;

a head housing part configured to house the inkjet head, wherein the inkjet head is configured to be separated from the head housing part in inkjet recording;

a humidity acquiring part configured to acquire a relative humidity of the nozzle surface of the inkjet head housed in the head housing part; and a temperature and humidity regulating part configured to perform at least one of a humidification process and a dehumidification process according to the relative humidity of the nozzle surface acquired by the humidity acquiring part to set the relative humidity of the nozzle surface to 37% RH or more and 65% RH or less.

2. The inkjet recording apparatus according to claim 1, further comprising a temperature and humidity sensor mounted in the head housing part so as to face the inkjet head, wherein the humidity acquiring part calculates the relative humidity of the nozzle surface according to a temperature and humidity measured by the temperature and humidity sensor.

3. The inkjet recording apparatus according to claim 1, further comprising:

an internal temperature and humidity sensor that is arranged outside the head housing part and inside the inkjet recording apparatus, and measures a temperature and humidity inside the inkjet recording apparatus; and an external temperature and humidity sensor that is arranged outside the inkjet recording apparatus, and measures a temperature and humidity outside the inkjet recording apparatus, wherein the humidity acquiring part has temperature and humidity data indicating a correspondence relationship between the temperatures and humidities outside and inside the inkjet recording apparatus and a temperature and humidity of the nozzle surface, and calculates the relative humidity of the nozzle surface according to the temperatures and humidities inside and outside the inkjet recording apparatus respectively measured by the internal temperature and humidity sensor and the external temperature and humidity sensor, and the temperature and humidity data.

4. The inkjet recording apparatus according to claim 1, further comprising:

a fixture unit to which the inkjet head is fixed; and a temperature and humidity sensor attached to the fixture unit, wherein the humidity acquiring part calculates the relative humidity of the nozzle surface according to a temperature and humidity measured by the temperature and humidity sensor.

5. The inkjet recording apparatus according to claim 4, wherein the temperature and humidity sensor is mounted on each of both ends of the fixture unit, and the humidity acquiring part calculates the relative humidity of the nozzle surface according to a temperature and humidity measured by the temperature and humidity sensor on each of both ends.

6. The inkjet recording apparatus according to claim 1, wherein the temperature and humidity regulating part performs the humidification process on the nozzle surface in a case where the relative humidity of the nozzle surface acquired by the humidity acquiring part becomes less than 37% RH, or becomes equal to or less than a first threshold that is larger than 37% RH, and performs the dehumidification process on the nozzle surface in a case where the relative humidity of the nozzle surface acquired by the humidity acquiring part becomes larger than 65% RH, or becomes equal to or more than a second threshold that is less than 65% RH.

7. The inkjet recording apparatus according to claim 6, wherein the head housing part holds a wetting liquid, and the temperature and humidity regulating part regulates at least one of a temperature of or an amount of the wetting liquid to perform the humidification process or the dehumidification process.

8. The inkjet recording apparatus according to claim 6, wherein the temperature and humidity regulating part adjusts a distance between the nozzle surface and the head housing part to perform the humidification process or the dehumidification process.

9. The inkjet recording apparatus according to claim 6, further comprising a fan that is provided to the head housing part and is configured to blow an air, wherein the temperature and humidity regulating part blows an air to the nozzle surface by use of the fan to perform the dehumidification process.

10. The inkjet recording apparatus according to claim 1, wherein while the inkjet head is housed in the head housing part, in a case where the relative humidity of the nozzle surface acquired by the humidity acquiring part becomes less than 37% RH, or becomes larger than 65% RH, a maintenance process is performed before the inkjet head carries out recording.

11. A control method for an inkjet recording apparatus comprising:

a head housing step of housing in a head housing part an inkjet head having a nozzle surface on which nozzles configured to eject an ink are formed, wherein the inkjet head is configured to be separated from the head housing part in inkjet recording;

a humidity acquiring step of acquiring a relative humidity of the nozzle surface of the inkjet head housed in the head housing part; and a temperature and humidity regulating step of performing at least one of a humidification process and a dehumidification process according to the relative humidity of the nozzle surface acquired in by the humidity acquiring step to set the relative humidity of the nozzle surface to 37% RH or more and 65% RH or less.

* * * * *